United States Patent [19]

Williams

[11] 3,959,997

[45] June 1, 1976

[54] PICK-PROOF LOCK SYSTEM AND METHOD FOR LOCKING A DOOR, WINDOW, OR OTHER CLOSURE

[75] Inventor: James E. Williams, Stamford, Conn.

[73] Assignees: James E. Williams, Stamford; William A. Williams, Danbury, both of Conn.

[22] Filed: Apr. 21, 1975

[21] Appl. No.: 569,869

Related U.S. Application Data

[63] Continuation-in-part of Ser. No. 449,330, March 8, 1974, abandoned.

[52] U.S. Cl. ..... 70/419; 70/423

[51] Int. Cl.[2] ..... E05B 63/00

[58] Field of Search ..... 70/352, 350, 390, 389, 70/416, 1.5, 419, 421, 423, 424, 425, 426, 427, 428, 455

[56] References Cited

UNITED STATES PATENTS

| | | | |
|---|---|---|---|
| 3,267,707 | 8/1966 | Adams | 70/423 X |
| 3,630,053 | 12/1971 | Krakauer | 70/421 |
| 3,714,804 | 2/1973 | French | 70/419 |
| 3,765,199 | 10/1973 | Wiczer | 70/423 |

*Primary Examiner*—Robert L. Wolfe

*Attorney, Agent, or Firm*—Parmelee, Johnson & Bollinger

[57] ABSTRACT

A pick-proof lock system and method for locking a door, window, or other closure which includes a first movable barrier such as a door mounted to be closed into a second related barrier such as a frame. This pick-proof lock system comprises coded locking means remotely located from the public region outside of the closure barriers with a transportable key movable along a route from the public region into the remote locking means and carrier means for moving the key along said route which may include multiple intersecting path segments with blocking means preventing access from the public region to the remotely located coded locking means, the carrier means acting cooperatively with said barrier means for moving the key long said route. The pick-proof method positions the coded locking means such as a tumbler assembly remote from the public region and places blocking means between the public region and the tumbler assembly, with the key being a transportable member carried away from the user's reach, passing along a route through the blocking means so as to enter and unlock the tumbler assembly, which at all times remains inaccessible to the public region. Movable carrier means are provided to transport the key along the route to the tumbler assembly while by-passing the blocking means. This route may be divided into a first path extending from the public region into the lock mechanism with a second path intersecting the first and extending offset into operative engagement with the tumbler assembly.

23 Claims, 30 Drawing Figures

Fig. 1.
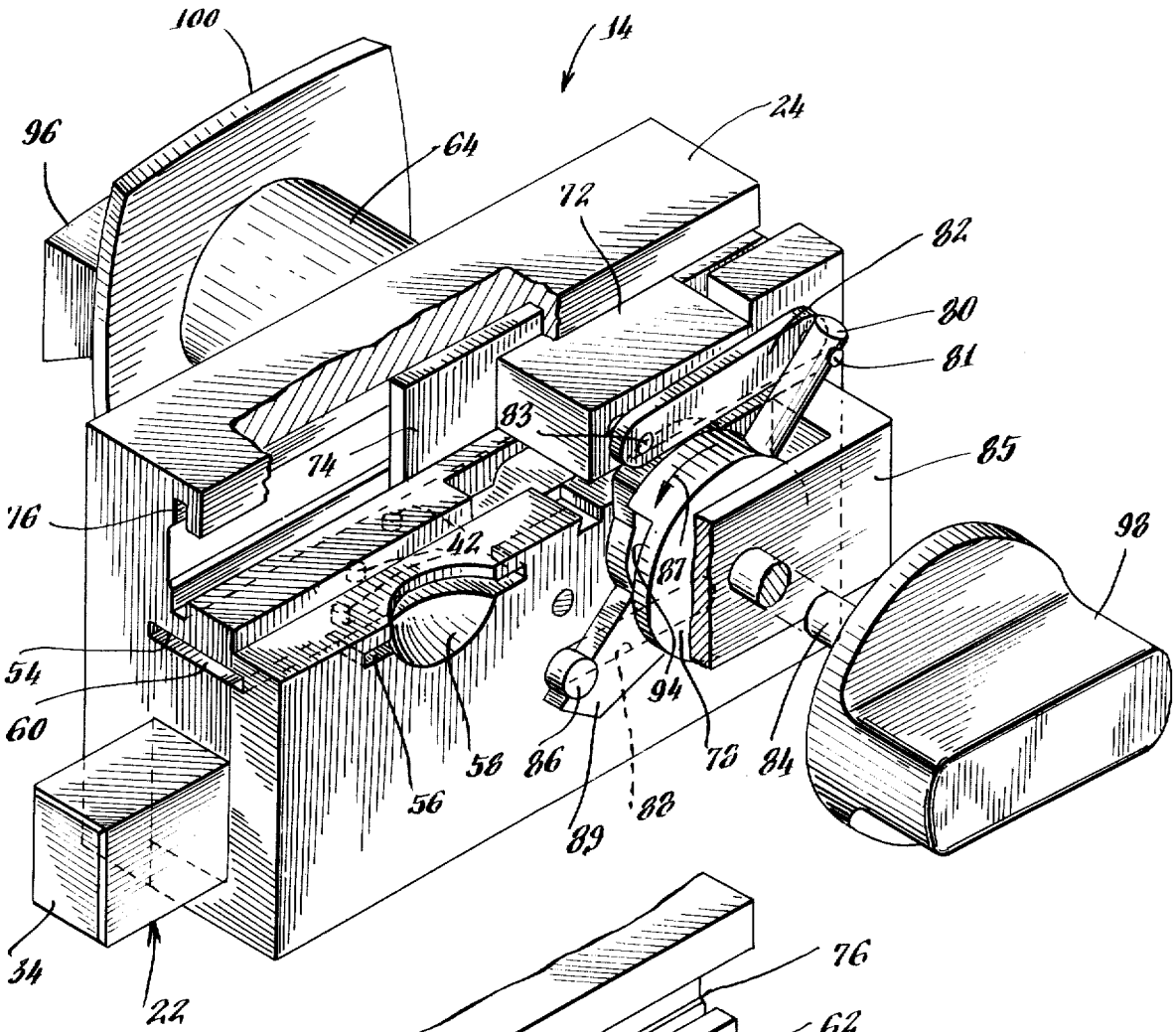
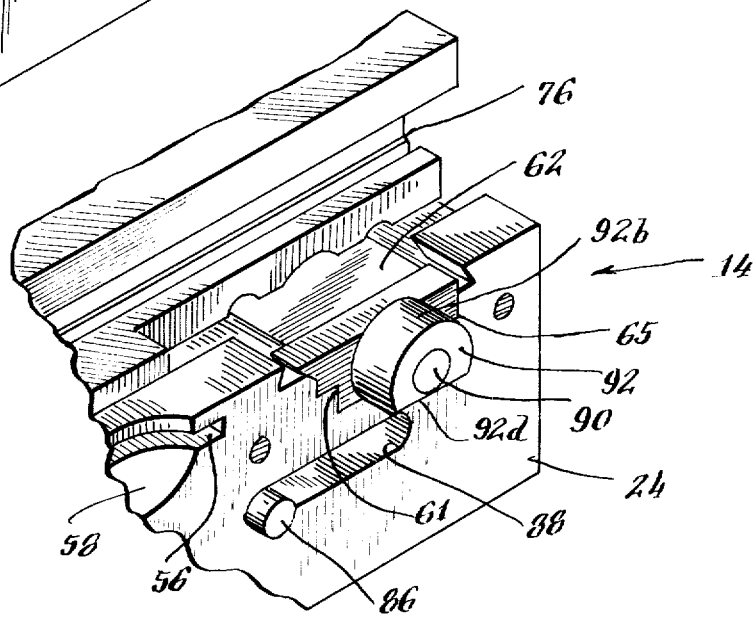
Fig. 9.

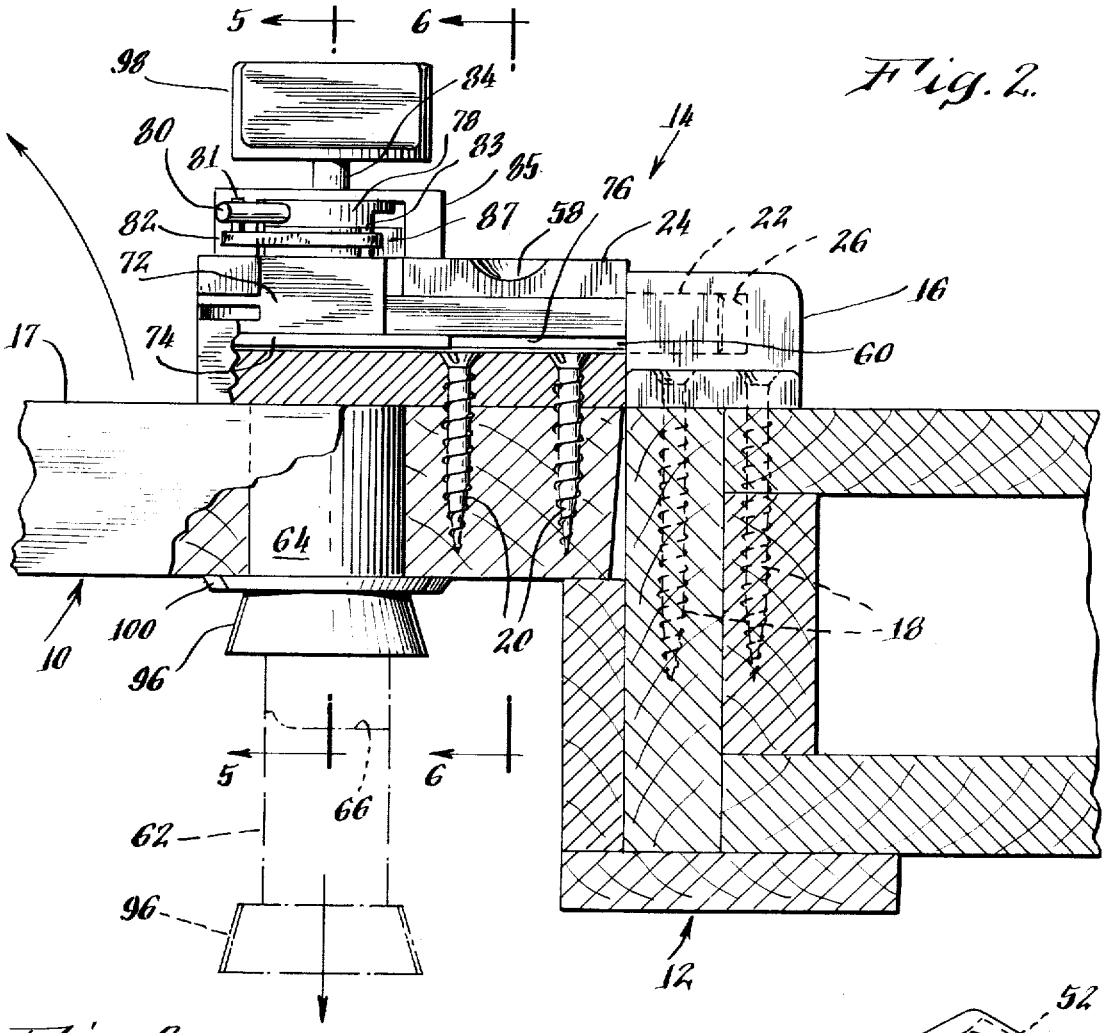
Fig. 2.
Fig. 3.
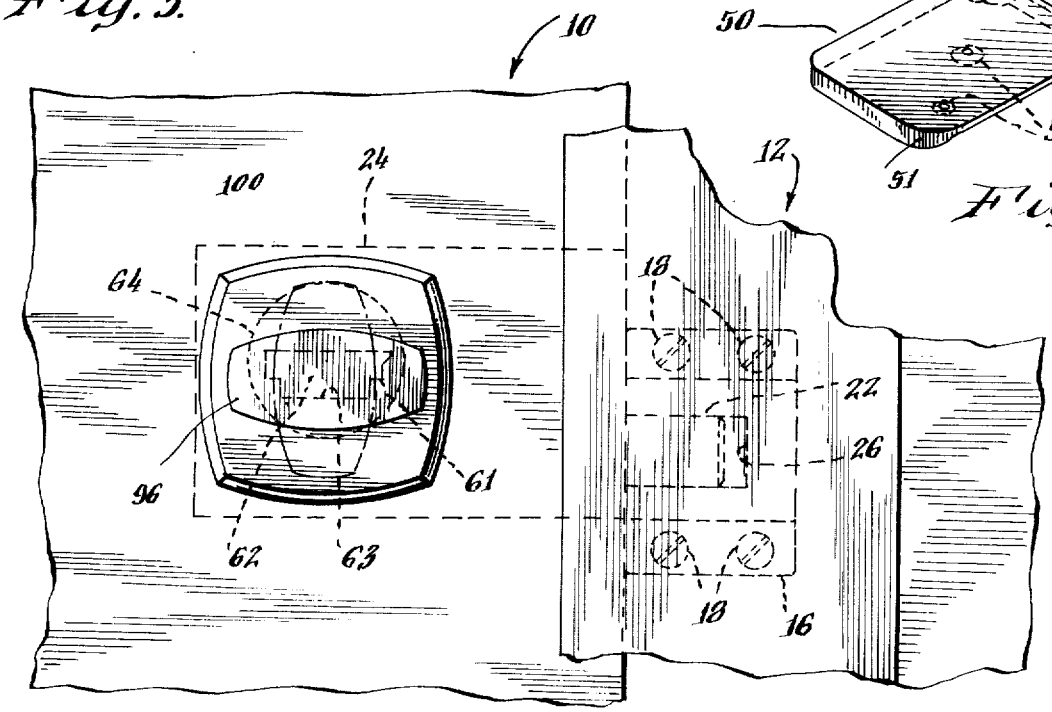
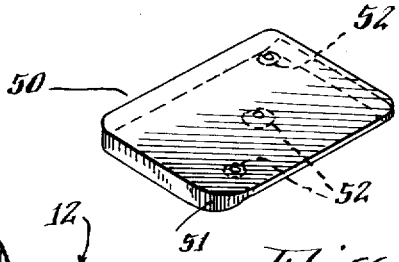
Fig. 4.

Fig. 15.
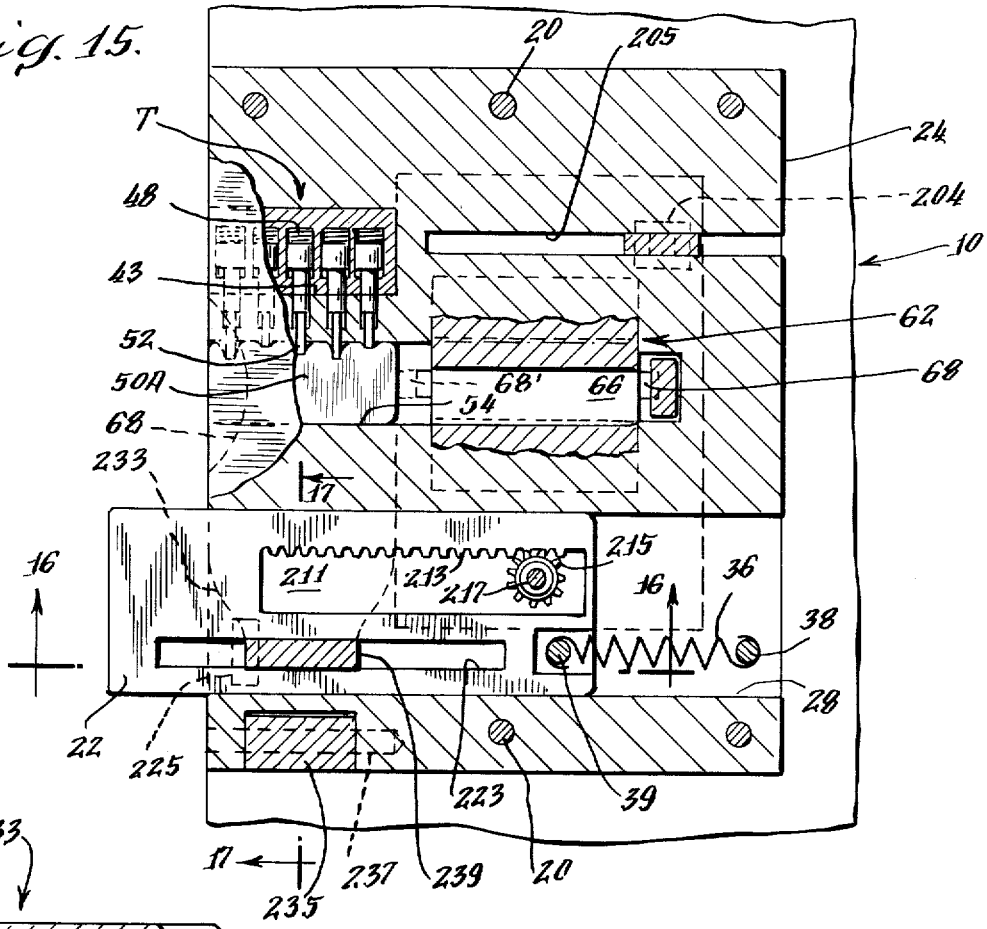
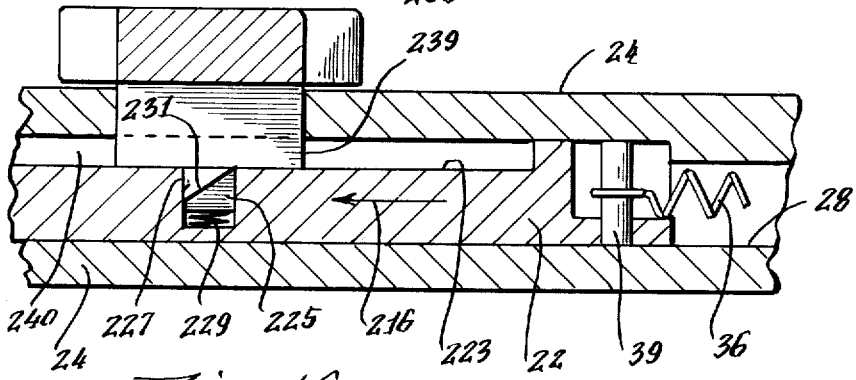
Fig. 16.
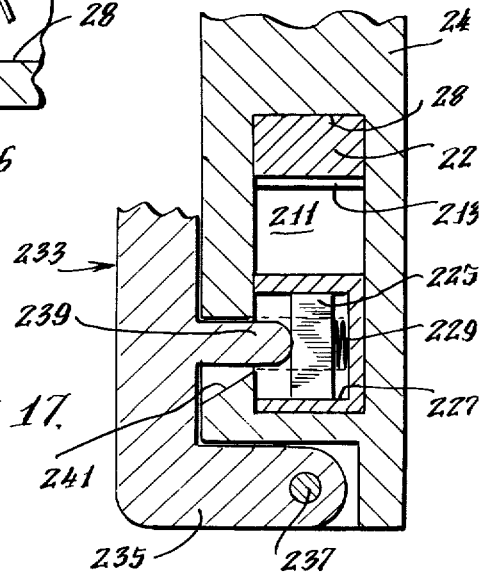
Fig. 17.

PICK-PROOF LOCK SYSTEM AND METHOD FOR LOCKING A DOOR, WINDOW, OR OTHER CLOSURE

This application is a continuation-in-part of application Ser. No. 449,330 filed Mar. 3, 1974, and now abandoned.

BACKGROUND OF THE INVENTION

This invention relates to a pick-proof lock system and method for locking closures such as doors, windows, or the like found in homes, offices, factories or other similar buildings. This lock system may be used with equal advantage to lock any other closure or barrier desired.

In recent years, security for many buildings has become of prime concern. Consequently, it is desirable to lock closures in such buildings in a manner that makes breaking and entering into them as difficult as possible.

Most locks presently used to lock closures include a lock mechanism having a coded tumbler assembly into which a key is directly inserted to actuate the lock mechanism.

Various forms of tumbler assemblies and keys have been developed in the past. A common key has a flat, elongated portion projecting from a larger more easily manipulated handle portion which the user holds. The elongated portion has a series of grooves on its faces which match a similar series of grooves in the tumbler assembly and permit the key to enter the assembly. A series of teeth on one or both edges displaces the respective coded tumblers. When these tumblers are properly aligned, the key may be turned to open the lock mechanism and thus the closure.

A second type of tumbler-key arrangement employs a hollow, cylindrical key having a series of coded teeth at one end in the cylindrical wall. These teeth displace a similarly coded series of tumblers, mounted around the periphery of a suitable cylindrical key hole or aperture, which when properly aligned permit the key to be turned to open the lock mechanism.

In each of these prior systems, the key is inserted directly into the tumbler assembly by the user and is manually manipulated in the lock mechanism to open it. Thus, the keyhole or entrance for the key into the lock mechanism is directly accessible to the exterior of the closure barrier, and thus the lock mechanism is exposed to insertion of counterfeited keys and lock-picking tools. A skillful thief can open the lock mechanism by manipulating the tumbler assembly with such a picking tool and then turning the mechanism. This constitutes a serious drawback in all of these prior art systems which is remedied by the present invention.

SUMMARY OF THE INVENTION

In accordance with this invention, the coded locking means, such as a tumbler assembly, is positioned remote from the public region outside of the closure barriers with a transportable key movable along a route extending from the public region into the remotely located coded locking means, and carrier means serve to move the key along this route which may include multiple intersecting path segments, while blocking means may be provided to prevent access from the public region to the coded locking means with the carrier means acting cooperatively with the barrier means for by-passing the barrier means to move the key along said route. The key is a transportable member which is carried away from the user's reach, passing along the route so as to enter and unlock the coded locking means, which at all times remains inaccessible to the public region. The coded locking means is only accessible with a properly formed key that is transported into the interior of the lock mechanism along the route which may comprise a sequence of offset path segments.

In an illustrative embodiment of the invention, the coded locking means in the form of a tumbler assembly is shown offset from the first path segment for carrying the key into the lock mechanism. Furthermore, the key travels along a sequence of noncollinear path segments when being moved into operative engagement with the tumbler assembly, at least one of these paths being blocked by the carrying means forming an obstacle to access when the key is being carried inward by this carrying means. Consequently, the remotely located tumbler assembly is not accessible from the public region for insertion of a picking tool.

In one illustrative embodiment of the present invention to be described below in detail, the pick-proof lock system for locking a door, window, or other closure having a first movable barrier mounted to close into a second related barrier includes a coded key, a fixed latching member mounted on one of the closure barriers, and a lock mechanism mounted on the other barrier. The lock mechanism includes a movable latching member, such as a bolt, adapted to engage the fixed latching member when it projects out of the mechanism to lock the closure, with a coded tumbler assembly for locking the movable latching member in this engaged latching position. The lock mechanism further includes a key guideway and a carrier for transferring the key through the guideway into operative engagement with tumbler assembly.

Key carrying means movable with respect to the tumbler assembly serves to accept and to carry the key and to transport the key into the tumbler mechanism while obstacles are provided preventing access to the tumbler mechansim from the public region. In one illustrative embodiment shown, the carrier means includes a key carrying member which is mounted on the lock mechanism offset from the tumbler assembly. This carrier member is adapted to be moved to expose a depression for insertion of the key. After the key is placed in the carrier member, the carrier member is further adapted to be moved for carrying the key along a route toward the tumbler assembly. This carrier member may be arranged to deposit the key in a guideway to be moved by a second carrier along a second path offset from the guideway and leading into the tumbler assembly itself.

This illustrative embodiment of this pick-proof lock system is operated as follows: The key carrier is partially withdrawn from the lock mechanism. The properly coded key is placed in a receptacle such as a depression in the carrier, and the carrier is retracted by manual or semi-automatic operation into the mechanism, depositing the key in operative relation with a second key carrier. A knob which is accessible in the public region is then rotated to move a second carrier thus pushing the key into operative engagement with the tumbler assembly. The movable latching member is thus released, and disengaged from the fixed latching member to unlock the closure. A spring in the lock mechanism may be provided to urge the movable latching member into its unlocked position or alternatively the movable latching member can be released by rotating the knob to its original starting position.

When the key carrier is retracted into the lock mechanism, it acts as a barrier to picking tools, thereby preventing access to the tumbler assembly. Moreover, the key is carried away from the user's hand which is blocked from access to the interior of the lock mechanism.

This illustrative embodiment of the present invention provides no means for retrieving the key from the lock mechanism from outside of the closure once the key has been transported into the tumbler assembly by the carrier means. If a forged or improperly coded key should be used, it can not be retrieved. However, it is subsequently displaced from the lock mechanism into a suitable receptacle, when the proper key is used to open the closure. Thus, when the authorized person has opened the closure with a proper key, the forged key will be found in the receptacle, thereby informing and warning the authorized person that a thief has attempted to gain access.

Additionally, this pick-proof lock system prevents the user from inadvertently leaving his proper key accessible in the lock because, when the key has been used, the key itself has been transferred into the interior of the lock mechanism where it is no longer accessible from outside of the closure.

Other embodiments of the pick-proof lock system and method embodying the present invention are also disclosed.

Accordingly, it is an object of the present invention to provide a unique and novel pick-proof lock system and method for locking closures such as doors, windows, and the like.

Other objects, aspects and advantages of this invention will be pointed out in or will become understood from the following detailed description when considered in conjunction with the accompanying drawings which are briefly described below.

BRIEF DESCRIPTION OF THE DRAWINGS

FIG. 1 is a partially exploded perspective view, with portions shown in section, of an embodiment of the pick-proof lock system of the present invention, as seen from inside of the closure;

FIG. 2 is a top plan view on reduced scale of the pick-proof lock system shown in FIG. 1. The lock mechanism is shown mounted on a door which is illustrated in cross-section;

FIG. 3 is a front elevational view of this pick-proof lock system as seen from the outside of the door on the same scale as FIG. 2. The lock face plate and key carrier handle can be seen in full lines, the remainder of the lock mechanism and the bolt socket member are illustrated in dotted lines;

FIG. 4 is a perspective view of a key used in this illustrative embodiment of the pick-proof lock system. Other configurations of keys including various transportable configurations can also be used, as will be explained further below;

FIG. 5 is drawn on the same scale as FIG. 1. The key carrier, the knob, a rotatable shaft, a drive wheel and linkage, and a second key carrier are shown;

FIG. 6 is drawn on the same scale as FIGS. 1 and 5;

FIG. 9 is a partial perspective view, with portions broken away to show interior working parts, as will be explained;

As illustrated in FIg. 14, when the key is in operative engagement with the tumbler assembly, this securing member swings back to release the latching member from its locked condition;

FIG. 15 is a cross-sectional view taken through plane 15—15 in FIG. 13 looking toward the left illustrating the latching member, shown as a bolt, the means for engaging this latching member with the securing member, and the arrangement for returning the latching member to its locked position;

FIG. 16 is a cross-sectional view taken through plane 16—16 of FIG. 15 looking up and showing in detail the relationship between the latching member and its securing member;

FIG. 17 is a cross-sectional view taken through the plane 17—17 if FIG. 15 looking toward the left and illustrating another view of the relationship between the latching member and its securing member;

Figure 20:
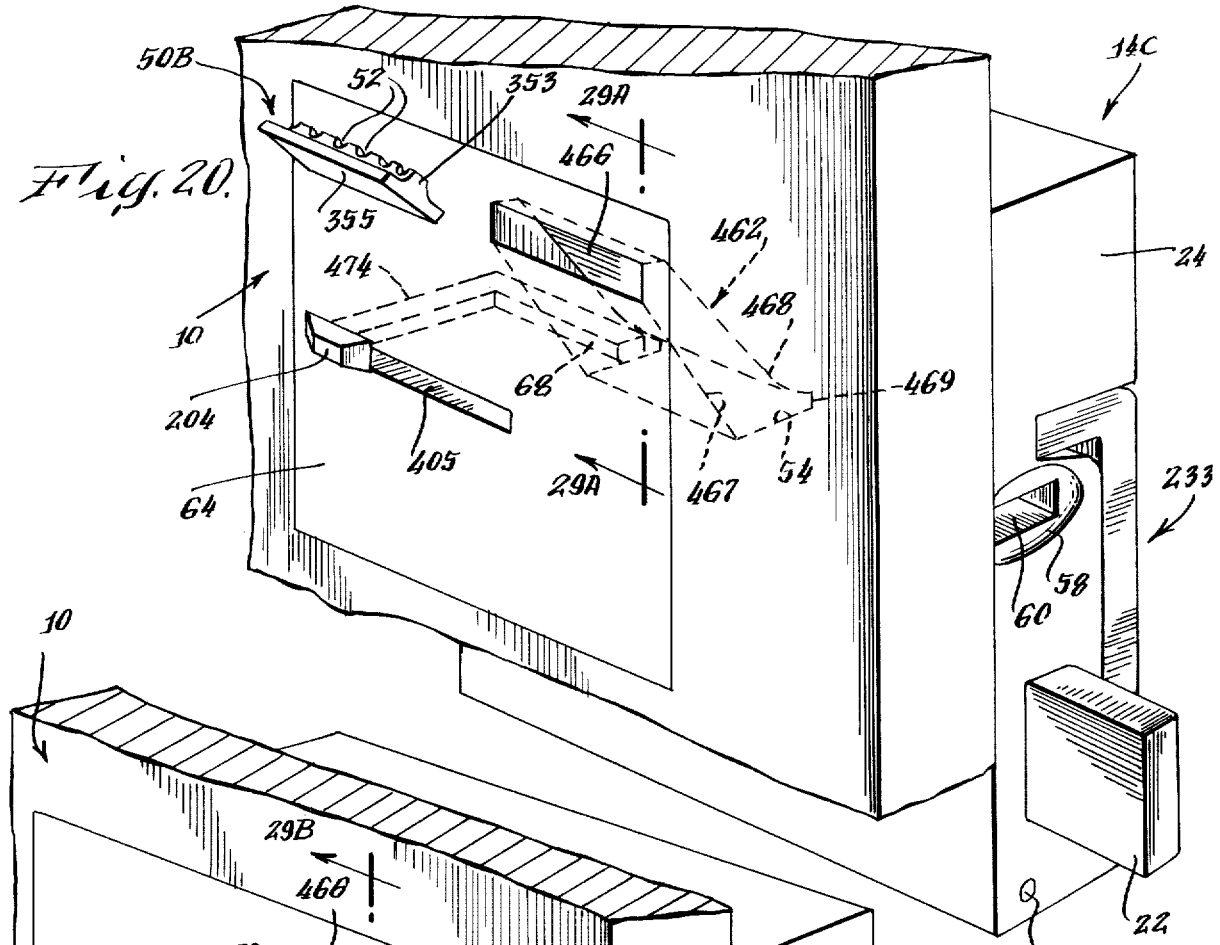
FIG. 20 is a perspective view of a fourth embodiment of the present invention also employing a lock mechanism identical to that used in the second embodiment.
Figure 21:
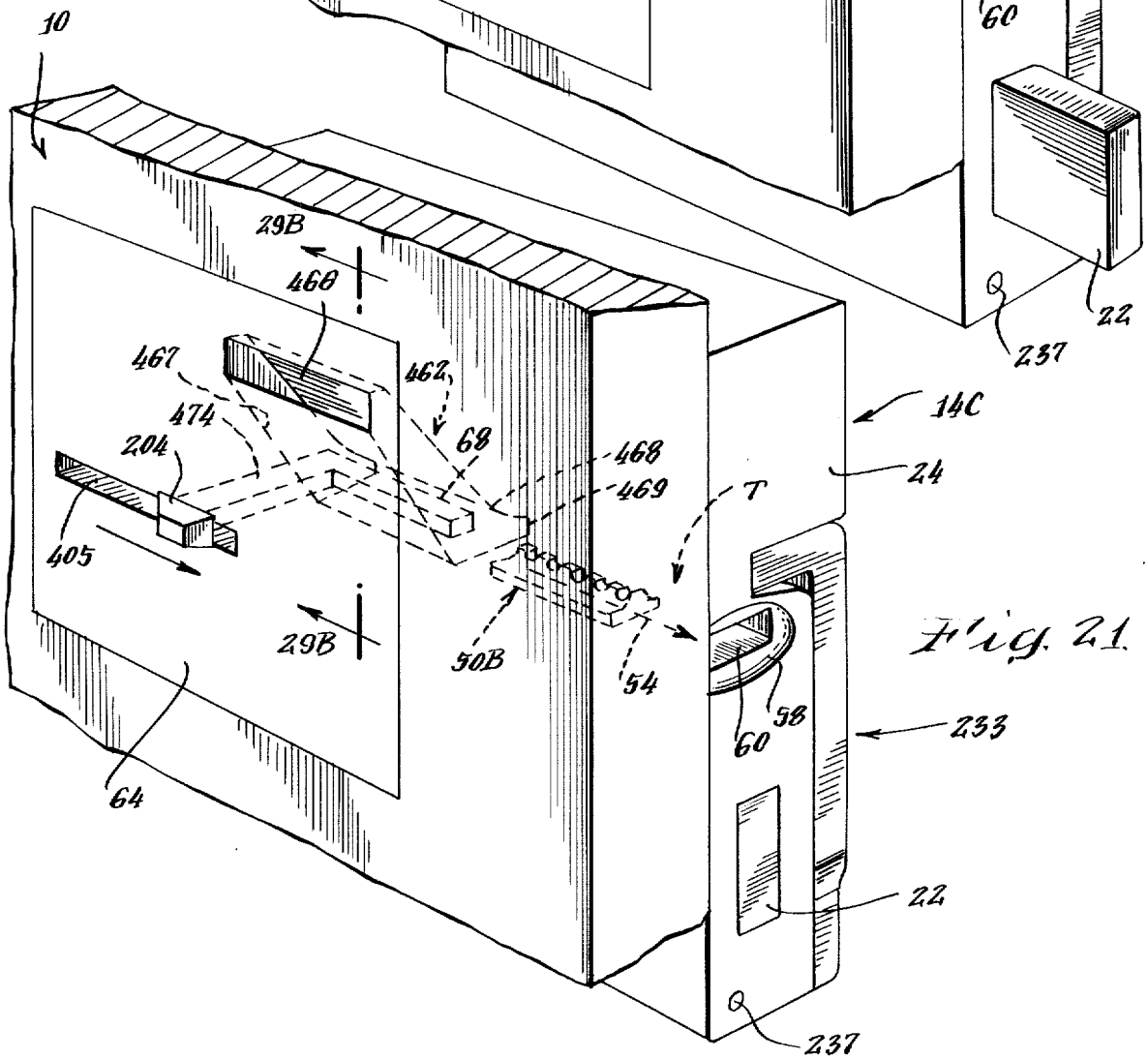
FIG. 21 is another perspective view of this fourth embodiment of the present invention shown in FIG. 20 after a key has been transported into the lock mechanism.
Figure 22:
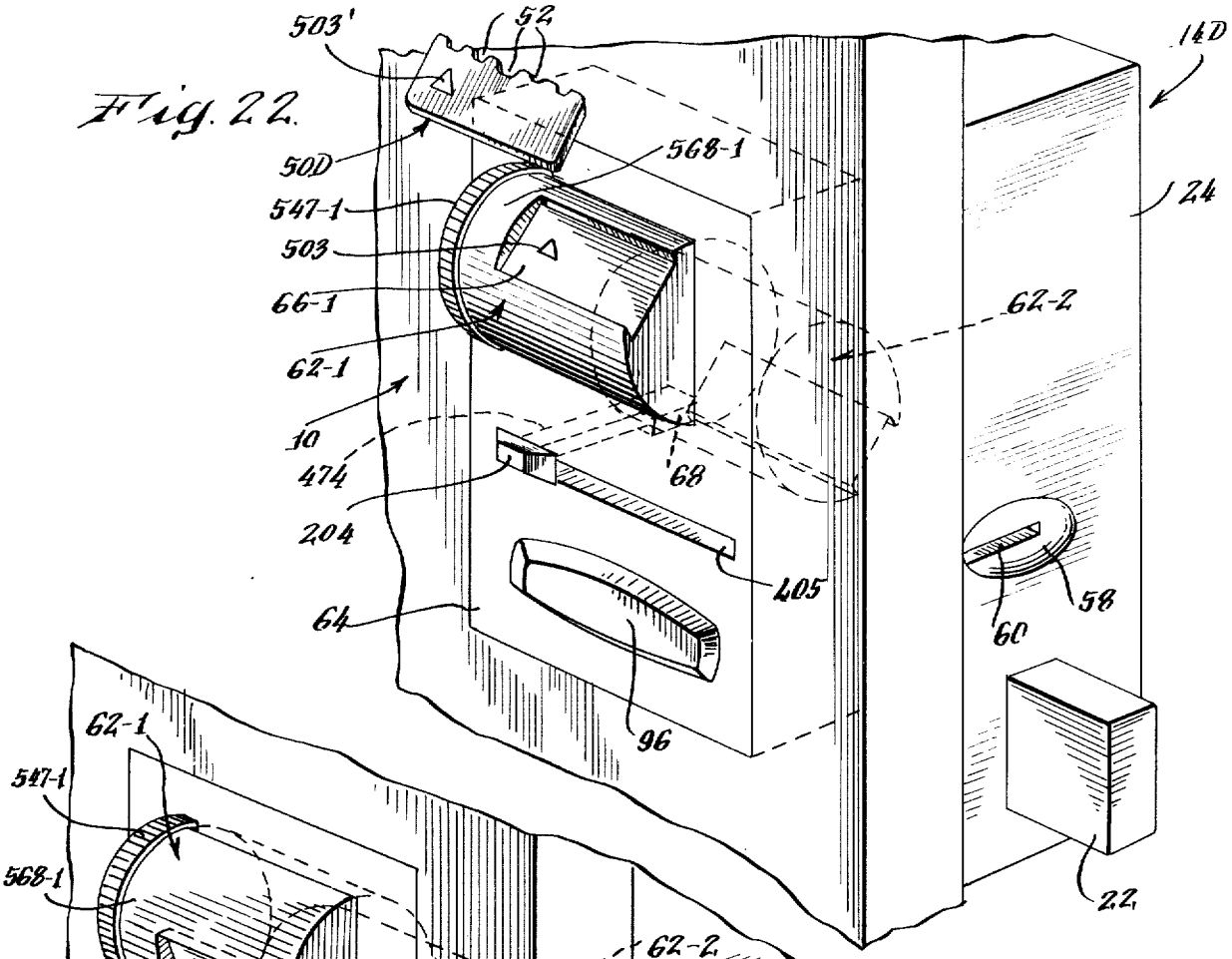
Figure 23:
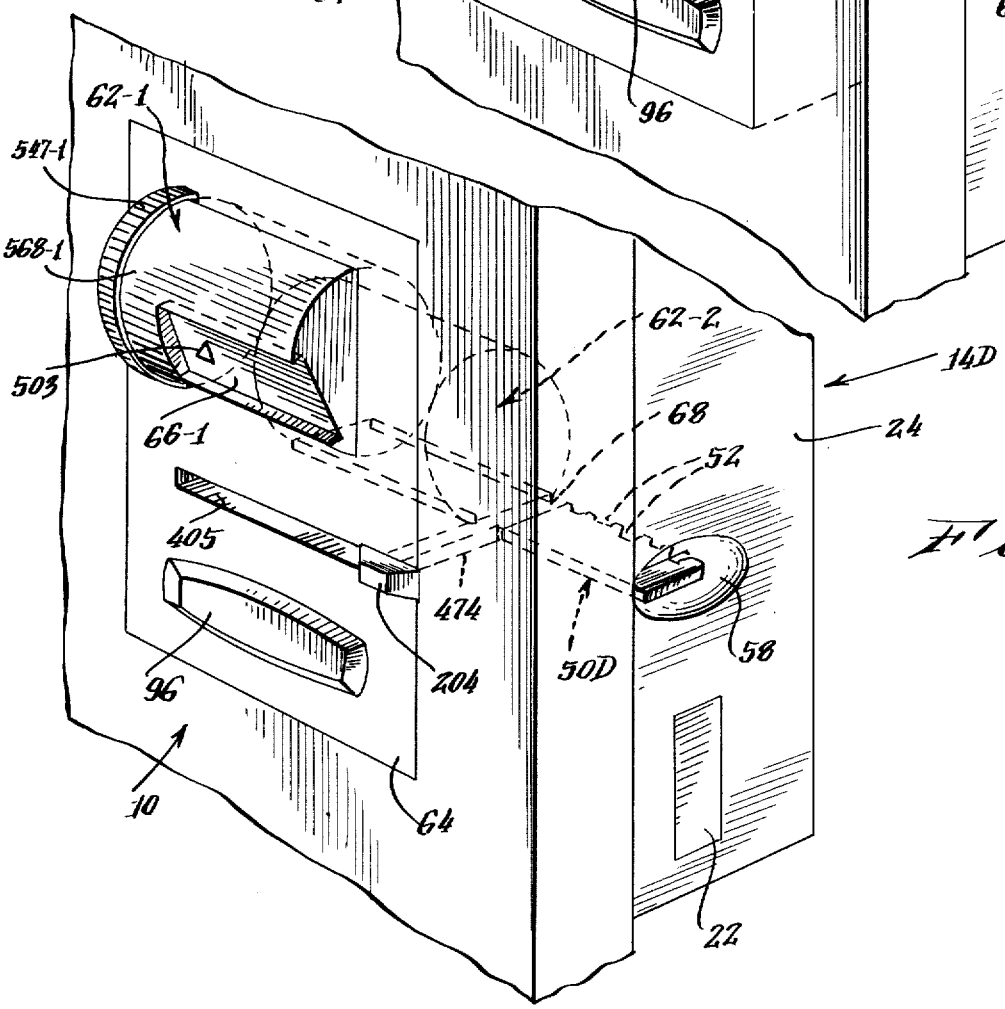
Figure 24:
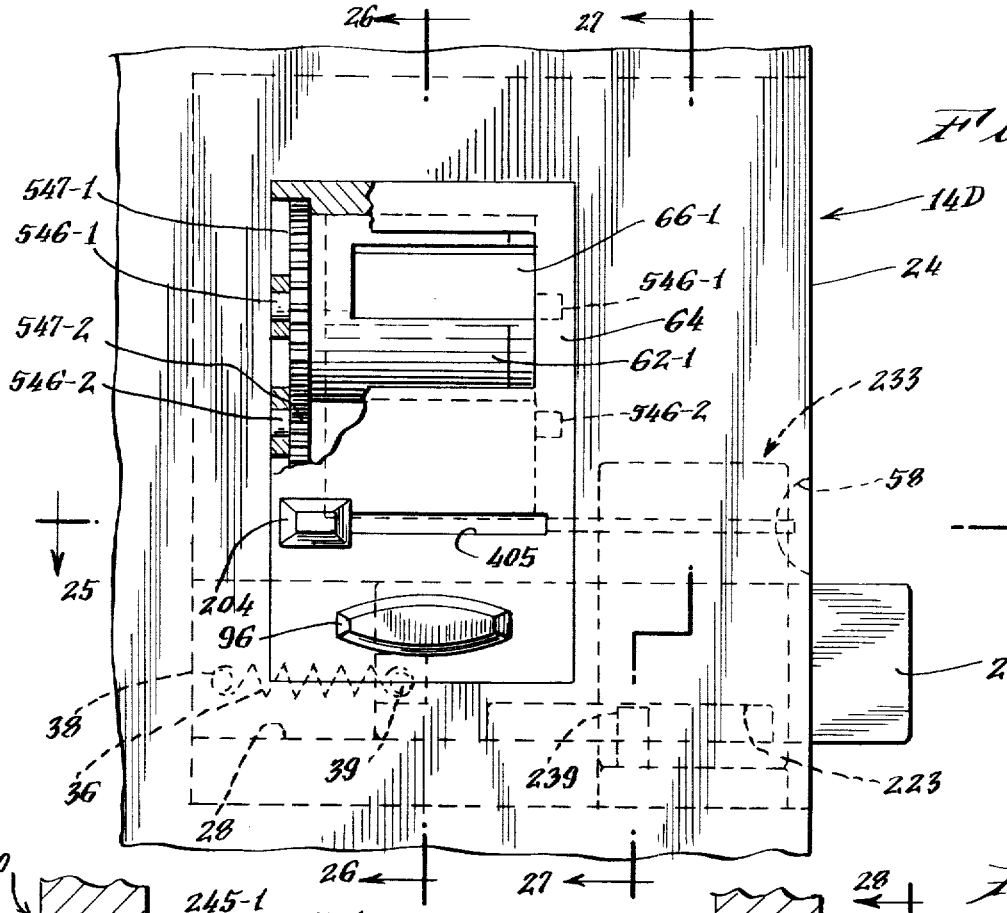
Figure 26:
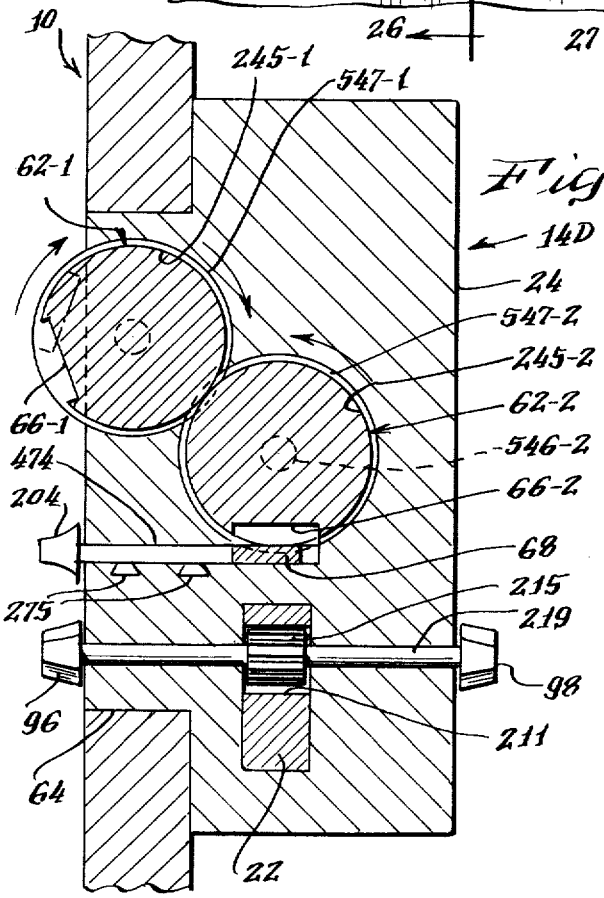
Figure 27:
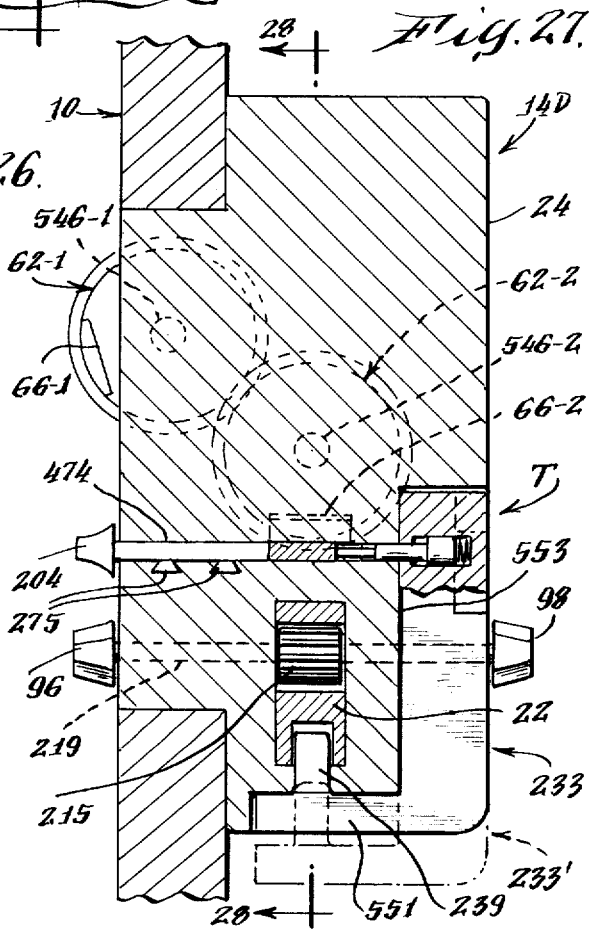
Figure 25:
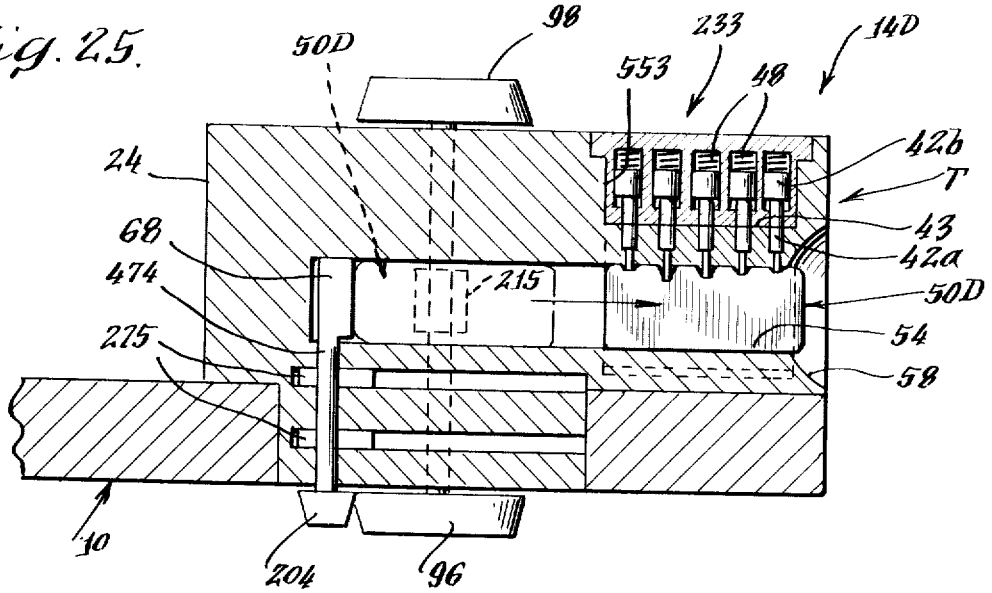
Figure 28:
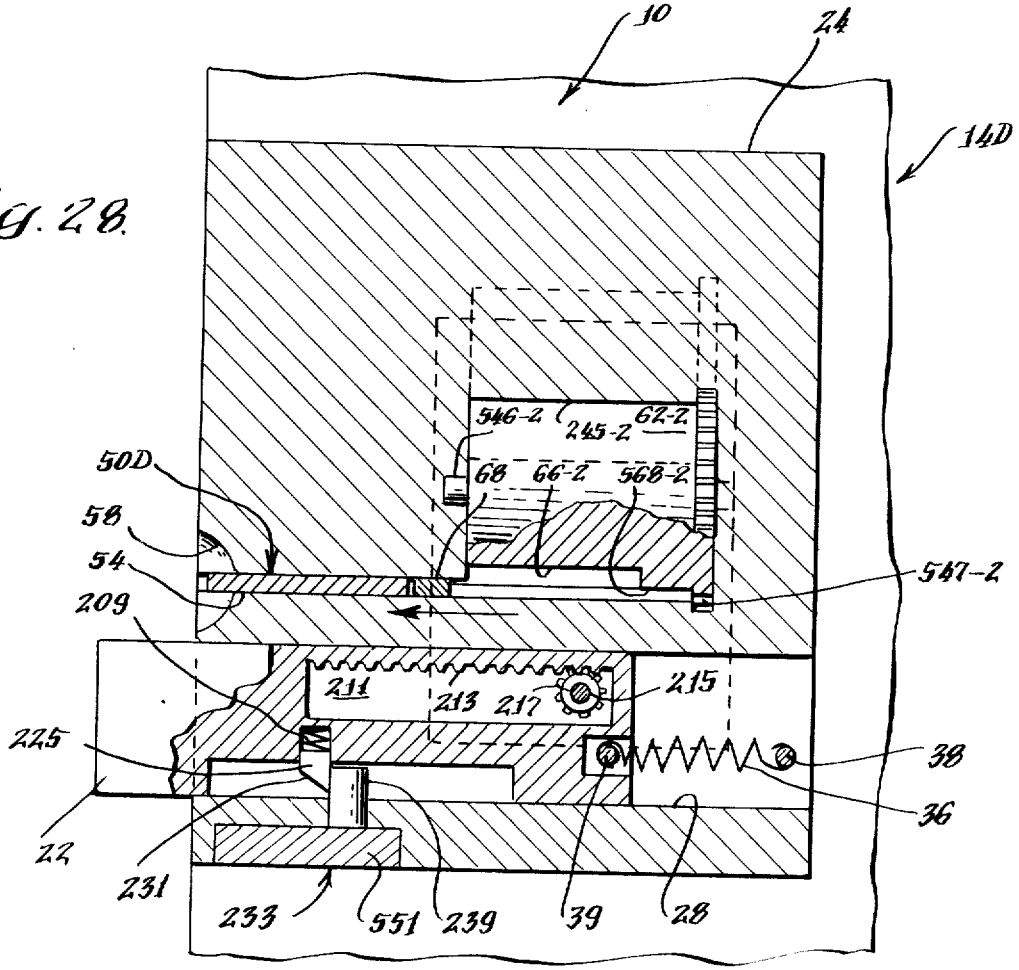
Figure 29A:
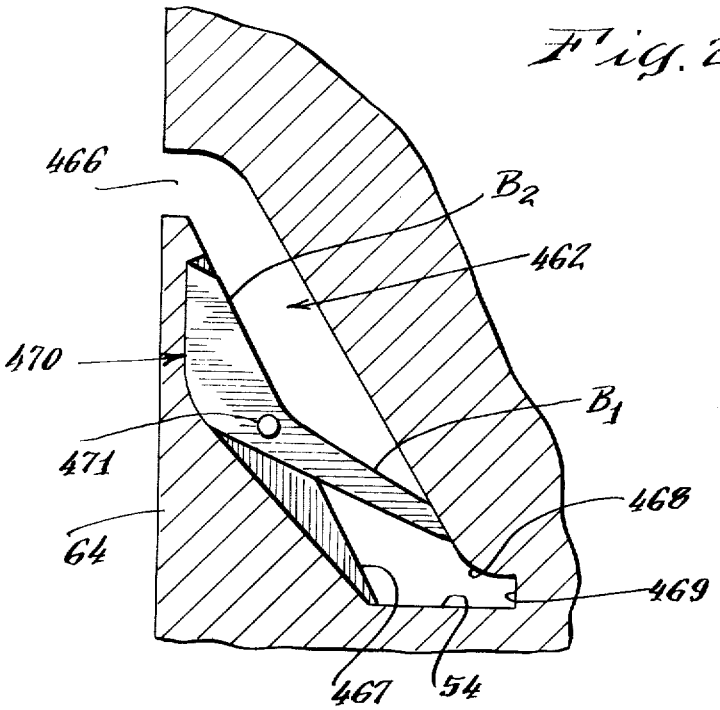
Figure 29B:
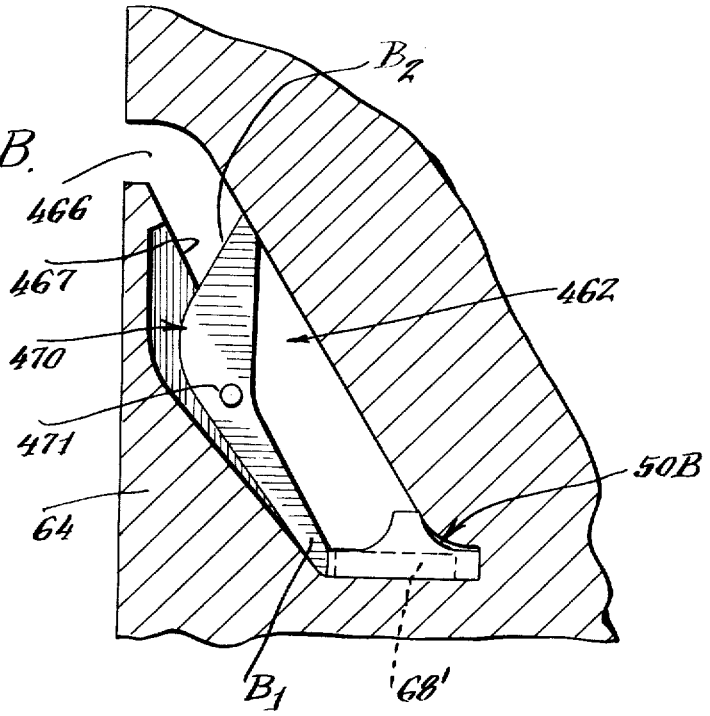

FIG. 22 is a perspective view of a fifth embodiment of the pick-proof lock system of the present invention having key carrier means including two counter-rotating drums;

FIG. 23 is a similar perspective view of this fifth embodiment illustrating the relative positions of the key carrier means after a key has been transported into the lock mechanism;

FIG. 24 is a front elevational view of this fifth embodiment shown in FIGS. 22 and 23 as seen from the outside of the closure barrier;

FIG. 25 is a plan sectional view taken through plane 25—25 in FIG. 24 looking down, illustrating the key guideway, the key pusher for moving the key through this guideway into engagement with the coded locking means;

FIG. 26 is a cross-sectional view taken through plane 26—26 in FIG. 24 looking toward the left and illustrating the counter-rotating drum carrier means for transporting the key from the outside of the closure barrier into the key guideway. In addition, the key pusher, key guideway and mechanism for returning the latching member or bolt to its locked position are illustrated;

FIG. 27 is a cross-sectional view taken through plane 27—27 in FIG. 24 looking toward the left, illustrating the means for securing the bolt in a locked position;

FIG. 28 is a cross-sectional view taken through plane 28—28 in FIG. 27 illustrating the bolt securing means, the spring mechanism for retracting the bolt and the mechanism for returning the bolt to its locked position; and FIGS. 29A and 29B show blocking means associated with the chute of FIGS. 20 and 21.

DETAILED DESCRIPTION OF THE ILLUSTRATIVE EMBODIMENTS

Referring to FIG. 2, the various components of the first illustrative embodiment of the pick-proof lock system of the present invention are shown in a locked position mounted on a door 10 and a corresponding door frame or jamb 12. The door 10 and jamb 12 form a typical closure which may be found in a home, office, factory, or any other building. Additionally, the pick-proof lock system of this invention may be mounted on any similar closure such as a window, overhead garage door, sliding door, ground-level basement door, hatch cover, gate, or any other closure which has a first moveable barrier and a second barrier with respect to which the first barrier closes. This lock system may also be used to lock closures such as file and desk drawers and sliding display doors.

The first illustrative pick-proof lock system embodying the invention includes a lock mechanism generally indicated at 14 shown mounted on the door 10, and a mating latching member 16, shown as a bolt socket member mounted on the jamb 12. This mounting arrangement may be reversed, i.e. the lock mechanism 14 may be mounted on the jamb with the socket latching member 16 mounted on the door, with equal advantage depending on the configuration of the closure. A number of large well-anchored screws 18 securely hold the socket latching member to the jamb 12.

The lock mechanism 14, shown mounted on the back surface 17 or inside of the door 10, is secured by a number of screws 20 and is positioned to be in alignment with the latching member 16 when the door is closed. Any strong fastening means which are not accessible from outside of the closure may be used instead of screws 18 and 20. When the door is sufficiently thick and strong, the lock mechanism 14 may also be mounted within a recess in the door structure itself with the mounting position of the latching member 16 being appropriately changed so as to be in alignment with the lock mechanism, as will be described in greater detail below.

The lock mechanism 14 includes a movable latching member 22, for example such as a retractable bolt, which is mounted for reciprocal movement in a main housing 24. The movable member 22 projects out of the housing 24 into latching engagement with the socket member 16, when the lock mechanism is in its locked condition. The latching member 16 is provided with a corresponding socket 26 which accepts this movable latching member 22 when it projects out of the main housing 24, as shown in FIGS. 2 and 3. In this manner, the door 10 is locked to the jamb 12 and prevented from opening until the movable latching member 22 is disengaged from the fixed member 16 by being withdrawn into the main housing 24.

Figure 8:
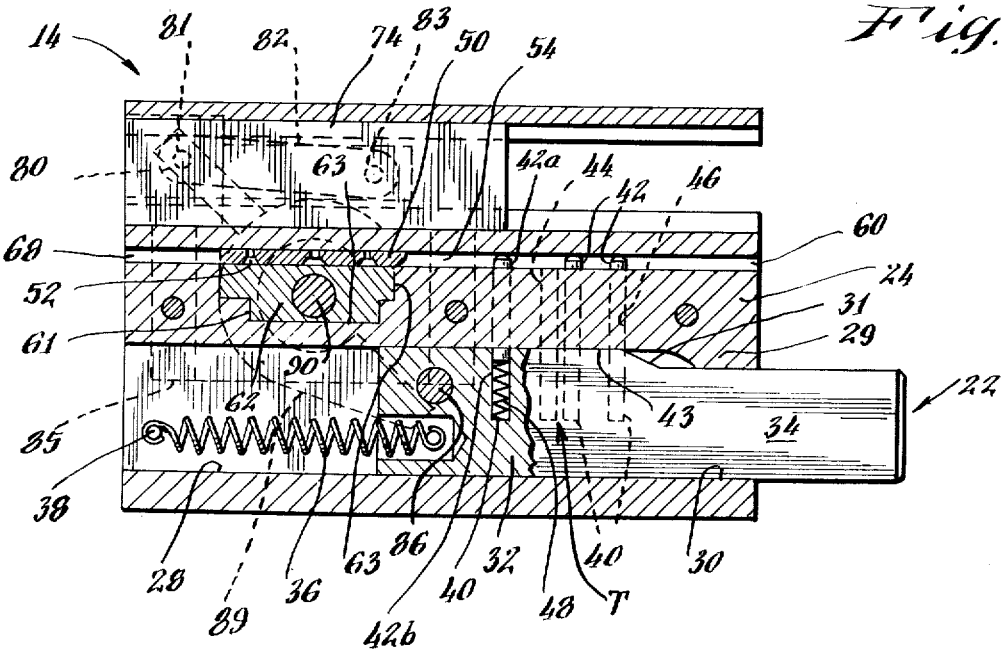
FIG. 8 is a cross-sectional view taken through plane 8—8 in FIG. 5 looking toward the right illustrating the spring which may be used to withdraw the bolt.

As shown in FIG. 8, the movable latching member 22 is carried in a channel 28 in the main housing 24 which has a lip portion 29 that vertically restricts the mouth 30 of the channel 28. The movable latching member 22 has a shoulder 31 positioned between an enlarged inner portion 32 and a smaller projectable end portion 34. This shoulder 31 acts as a stop by engaging the lip portion 29 so that the enlarged inner portion 32 is prevented from passing this channel mouth 30. A spring 36, hooked at one end to a pin 38 which spans the channel 28 and hooked at the other end to the movable latching member 22, urges this member toward its retracted or withdrawn position in the main housing 24.

Figure 7:
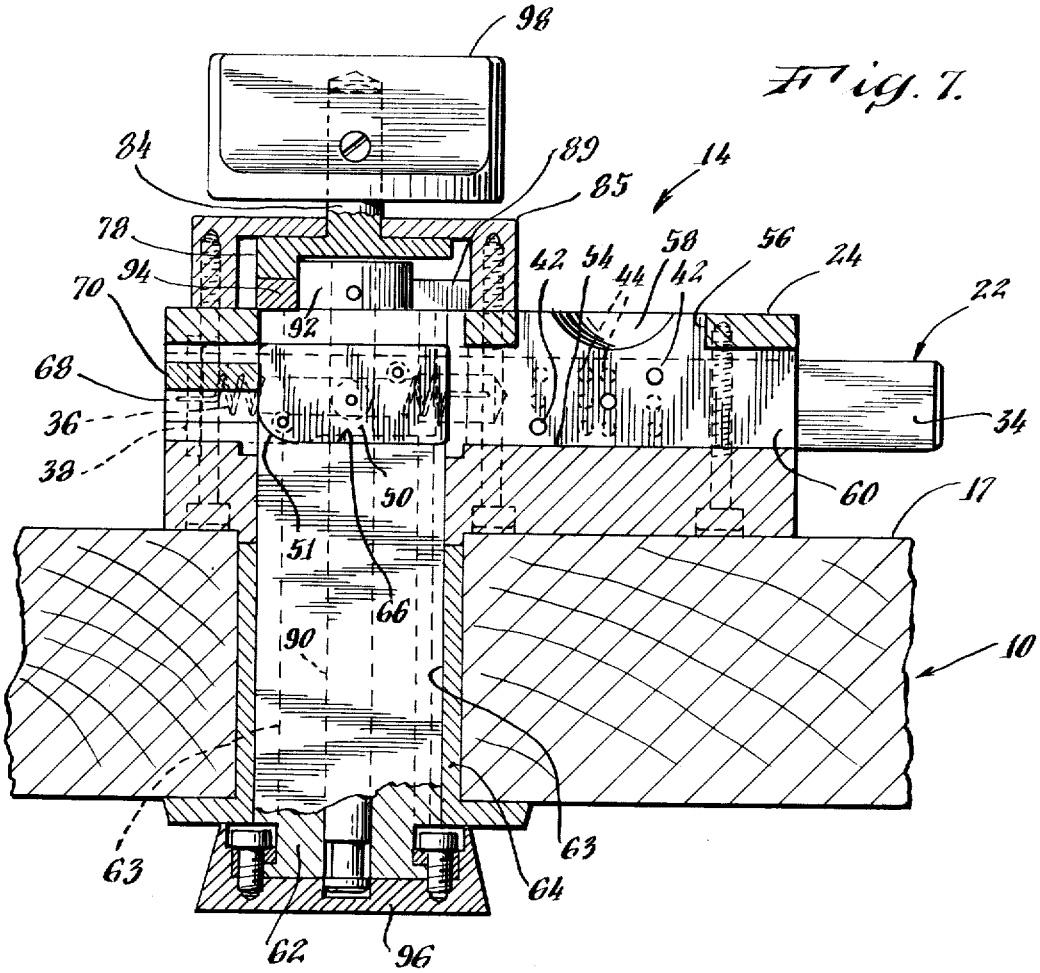
FIG. 7 is a cross-sectional view taken through plane 7—7 in FIG. 5 looking down illustrating the first key carrier, shown as a slide, the bolt, and a key guideway.

The movable latching member 22 has a series of transverse cylindrical holes 40 drilled in its enlarged portion 32 arranged in a preselected pattern such as that shown in FIG. 7. Each hole 40 carries either a portion of a two-segmented tumbler 42, or a blank tumbler 44. The two-segmented tumblers 42 further project into a corresponding pattern of holes 46 located in the main housing 24, communicating with the bolt channel 28, the tumblers being urged into these holes 46 under the influence of compressed springs 48. The blank tumblers 44 only occupy the holes 40 in the movable latching member 22.

This arrangement of tumblers 42 and 44 in the movable latching member 22 and in the main housing forms a tumbler assembly T. This assembly is coded by chosing various lengths for the two segments constituting each two-segmented tumbler 42. When such a tumbler moves upward under the influence of the force of its spring 48, its lower segment **42*b* occupies a portion of both the holes 40 and 46 in the movable latching member and housing thus locking the latching member 22** in its extended or projecting position.

However, when all of the tumblers 42 are depressed preselected amounts against the spring force by a proper key so as to cause all of the interfaces between the respective upper and lower tumbler segments **42*a* and 42*b* simultaneously to coincide with the interface 43 between the movable latching member and the main housing, the tumbler assembly no longer operates to lock the movable member in its extended position. Thus, when all segmented tumblers are appropriately depressed by varying amounts, the member 22 is released and can be withdrawn into the housing by the spring 38. The tumbler assembly is distinctively coded by varying the length of the upper tumbler segments 42***a* and thus requiring various amounts of tumbler depression to properly align the tumbler segment interface with the interface 43.

This tumbler assembly T is operated by a special key 50 (FIG. 4) which has a rectangular shape. This key 50 is provided with a pattern of depressions 52 on one of its faces. Each depression is positioned to operate a given two-segmented tumbler 42 and is of such depth that it will depress the tumbler which it operates by an appropriate preselected amount to align the tumbler segment interface with the interface 43. In this manner, the key is correspondingly coded to the tumbler assembly T.

The blank tumblers 44 and the two-segmented tumblers 42 may be interchanged to change the code of the tumbler assembly. Or segmented tumblers may be added or removed to accomplish such a change. A differently coded key must be provided to operate the differently coded tumbler assembly.

Figure 6:
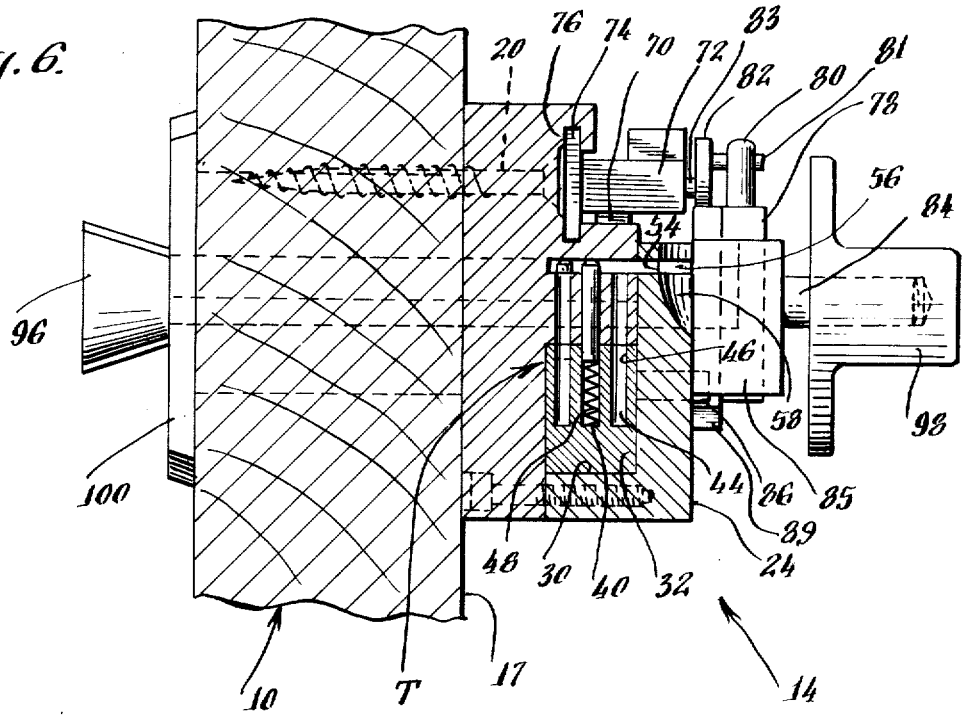
FIG. 6 is a cross-sectional view taken through plane 6—6 in FIG. 2 looking toward the left illustrating the movable latching member, shown as a bolt, and the tumbler assembly.

As shown in FIGS. 1, 6, and 8, the key 50 is guided to the tumbler assembly T by a key guideway 54 formed in the lock mechanism main housing 24. This guideway 54 has dimensions which permit free movement of the key 50 along a second path defined by this guideway 54. Additionally, the guideway 54 is accessible to a key in two different ways. The key 50 may be inserted directly into an inside access slot 56 (FIG. 1) in the rear of the lock mechanism 14 which positions it in the guideway 54 in operative engagement with the tumbler assembly T. Thus, the lock system may be opened from the inside of the door 10 by inserting a key directly through the inside slot 56 into operative relationship with the tumbler assembly T. A finger clearance depression or cut-out 58 is provided so that the operator may conveniently grasp the key 50 while inserting or removing it from the slot 56.

The key 50, regardless of whether the tumbler assembly is unlocked, may be ejected from the discharge end 60 (FIG. 1) of the guideway 54.

Alternatively, the key 50 may be inserted into this key guideway 54 from outside of the door 10 by passing along a first path under the control of a first key carrier. This first path intersects with the second path defined by the guideway 54, as will be explained. As shown in FIGS. 2, 3, and 5 – 8, this key carrier includes a slide 62 having a wide rectangular cross-sectional shape (FIG. 8) with two rabbeted edges 61 and 65. This slide 62 is mounted for reciprocal movement in a channel 63 disposed in a larger housing element 64 of cylindrical shape which is in turn mounted in the door 10. This slide is offset from the tumbler assembly as can be seen in FIGS. 1, 2, 7, and 8. The key carrier slide 62 has a specially shaped depression 66 (FIG. 7) for accepting the key. As shown in FIG. 4, the key has an index 51, such as an exaggeratedly rounded corner. The slide depression 66 has a matching index, for example such as a similarly rounded corner, so that the key can only be placed in the depression 66 in the proper attitude.

As shown in FIG. 2, the key carrier slide 62 may be withdrawn from the cylinder 64 to expose the depression 66 so that the key 50 may be deposited in it. The slide 62 may then be retracted by manually pushing it back into the housing element 64, thereby transporting the key (carried in the depression 66) along a first path passing through the door into the lock mechanism. Whenn fully retracted, the key carrier slide 62 positions the depression 66 and, hence, the key in direct alignment with the second path within the lock mechanism defined by the key guideway 54 (see FIG. 7).

In operation, the key has been carried along a first path commencing outside of the door, being carried along this first path by the key carrier 62. Now that the key carrier is fully retracted, the first path intersects the second path defined by the guideway 54. The key is now aligned with this second path in position to be transported along the second path into operative engagement with the tumbler assembly. This configuration is best illustrated in FIGS. 7 and 8. It is to be noted that the first path through which the key travels in the carrier 62 is offset from the second path defined by the key guideway. The first and second paths are noncollinear. The route followed by the key has an L-shaped configuration when viewed from above as seen in FIGS. 2 and 7.

Figure 5:
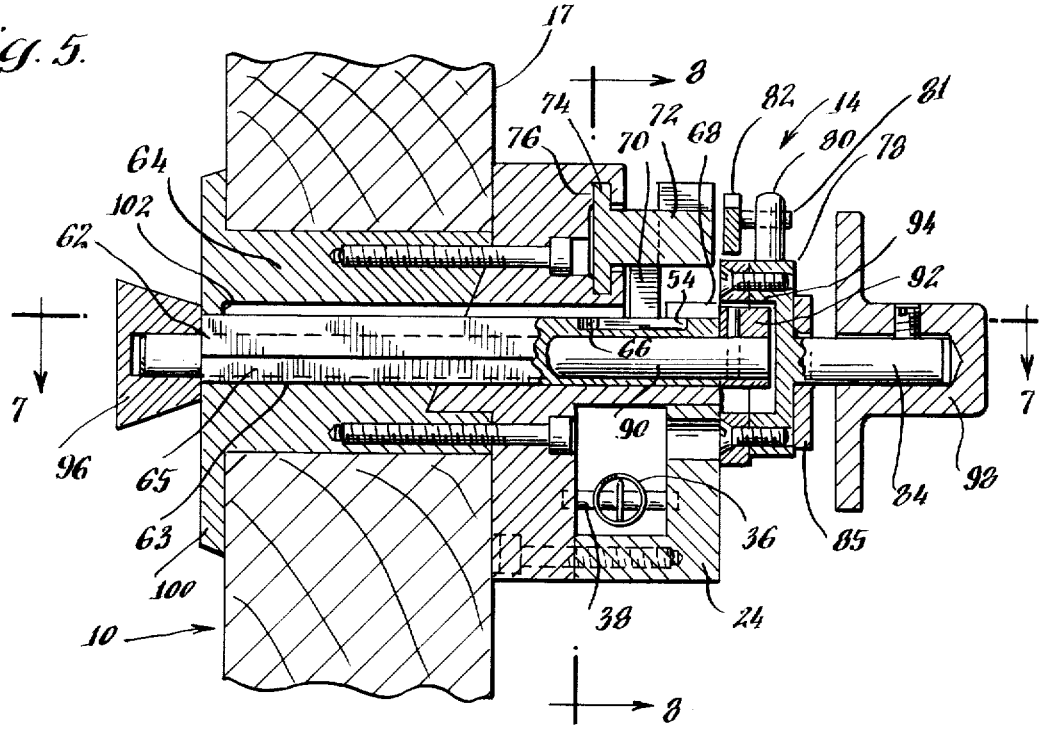
FIG. 5 is a cross-sectional view taken through plane 5—5 in FIG. 2 looking toward the left.

As shown in FIGS. 5 and 8, a second key carrier 68 is positioned to push the key 50 through the guideway 54. This second key carrier 68 acts as a ram, being mounted at the base of a vertical leg 70 (FIGS. 5 and 8) which projects downwardly from a sliding block 72. This block 72 is supported on a T-shaped traveller 74 which is slidable along a corresponding T-shaped slot 76 located in the main housing 24. This arrangement is shown in FIGS. 1, and 5 – 8.

The ram 68 and the sliding block 72 are coupled to a drive wheel 78 (FIG. 1) by a stud arm 80 which projects radially outwardly from the drive wheel 78. A connecting link 82 is pivotally connected by a pivot pin 81 to the arm 80 and is pivotally connected by another pin 83 to the sliding block 72. The drive wheel 78 is mounted for rotation on an axle 84 (FIG. 1) which is carried in a bracket 85 that is fixed to the rear of the lock mechanism 14 by a suitable means such as screws or by welding. Thus, when the drive wheel 78 is rotated in the counterclockwise direction, as shown by the arrow 87 in FIG. 1, the block 72 and hence the ram 68 move to the left, pushing a key 50 disposed in front of the ram 68 through the guideway 54 into operative engagement with the tumbler assembly T.

The drive wheel 78 has a second stud arm 89 (FIG. 1) which projects radially outwardly from it. This stud 89 abuts a pin 86 which is fixed to the movable latching member 22 and projects out through an elongaged slot 88. Thus, when the drive wheel 78 is rotated in the clockwise direction as seen in FIG. 1, the stud 89 pushes the pin 86 leftward and hence pushes the member 22 into its extended position to be locked by the tumbler assembly T.

A shaft 90 is rotatably carried in the key carrier slide 62 for reciprocal movement with it. The inner end of this shaft is provided with a clutch dog or coupling member 92 (FIG. 7) that registers with a similarly shaped coupling 94 in the drive wheel 78 when the carrier slide is fully retracted into the lock mechanism. The shaft 90 also has a handle 96 to facilitate its rotation to thereby rotate the drive wheel. This handle 96 also serves to withdraw the key carrier slide 62. The handle 96 cannot be turned until the slide 62 is fully retracted, due to flat surface 92*d* (FIG. 9).

A similar knob 98 is carried on the axle 84 of the drive wheel 78 so that drive wheel may be rotated to move the second key carrier 68 from inside of the door.

The coupling member 92 has one flat side 92*d* which slides on the bottom of the channel 63 (FIG. 8) in which the key carrier slide 62 is mounted. An upper rounded portion 92*b* abuts the interior of the face plate 100 at 102 (FIG. 5) to prevent complete withdrawal of the slide 62.

The pick-proof lock system shown in FIGS. 1 through 9 is operated as follows: The key carrier slide 62 is withdrawn as shown by arrow 103 (FIG. 2) along the channel 63 in the housing element 64 until stopped by the abuttment of the coupling member 92 and the stop 102. This exposes the slide depression 66 into which a key 50 is deposited. The slide 62 is retracted into the housing element 64 transporting the key 50 into the guideway 54 in front of the second key carrier 68. At this time, the coupling member 92 registers with the drive wheel socket 94. The handle 96 can then be rotated, turning the shaft 90 thus rotating the drive wheel 78 and moving the key carrier 68 by means of the arm 80 and connecting link 82. This operation pushes the key 50 along the guideway 54 into operative engagement with the tumbler assembly T. If the key is properly coded, the two-segmented tumblers are depressed so their segment interfaces coincide with the interface 43 thus unlocking the member 22. The spring 36 retracts the movable latching member 22 withdrawing it from the socket 26 in the fixed latching member 16 to unlock the door.

If the key is not properly coded, it will not unlock the door. However, when a properly coded key is used as described above, it merely ejects the improper key from the open guideway end 60 into an appropriate receptacle, not shown.

The lock may be opened with equal ease from the inside of the door by manually inserting a properly coded key directly into the slot 56 (FIG. 1).

As shown in FIG. 4, the key has two beveled edges 50*a* and 50*b*. Further, as shown in FIGS. 6 and 8, the tumbler tops are also beveled. This permits the key to slide easily into the tumbler assembly either when pushed by the carrier 68 through the guideway 54 or when directly inserted into the slot 56.

As noted, this lock system may be designed to be mounted in the door structure itself. To do so, the housing element 64 and slide 62 are merely shortened sufficiently for the lock mechanism 14 to be counter sunk into the inside surface 17 of the door structure. The socket member 16 accordingly shifted.

It is to be understood that the tumbler assembly T (FIGS. 6, 7 and 8) is shown as an example of coded lock means adapted to be opened by a properly coded key. Other suitable coded lock means may be used with other forms of transportable keys, as will be described in connection with the other embodiments shown herein.

In lieu of using the spring 36 (FIG. 8) for retracting the movable latching member or bolt 22, the arm 89 (FIG. 1) may be mechanically coupled as indicated at 99 to the pin 86 in the bolt. This mechanical coupling 99 may be a light extensible spring. Thus, after the coded lock means T is unlocked, the knob 96 or 98 may be rotated to swing the arm 89 toward the right in FIG. 1 for retracting the bolt 22. However, if the coded lock means T is not unlocked, then moving the arm 89 does not retract the bolt, for the light spring 99 merely stretches.

A second embodiment of the pick-proof lock method and system for locking a movable closure barrier with respect to another barrier is illustrated in FIGS. 10 – 17. Reference numerals used to identify structural components and characteristic elements of the first embodiment of the present invention will be used below to identify similar structural components and elements in later embodiments.

Figure 10:
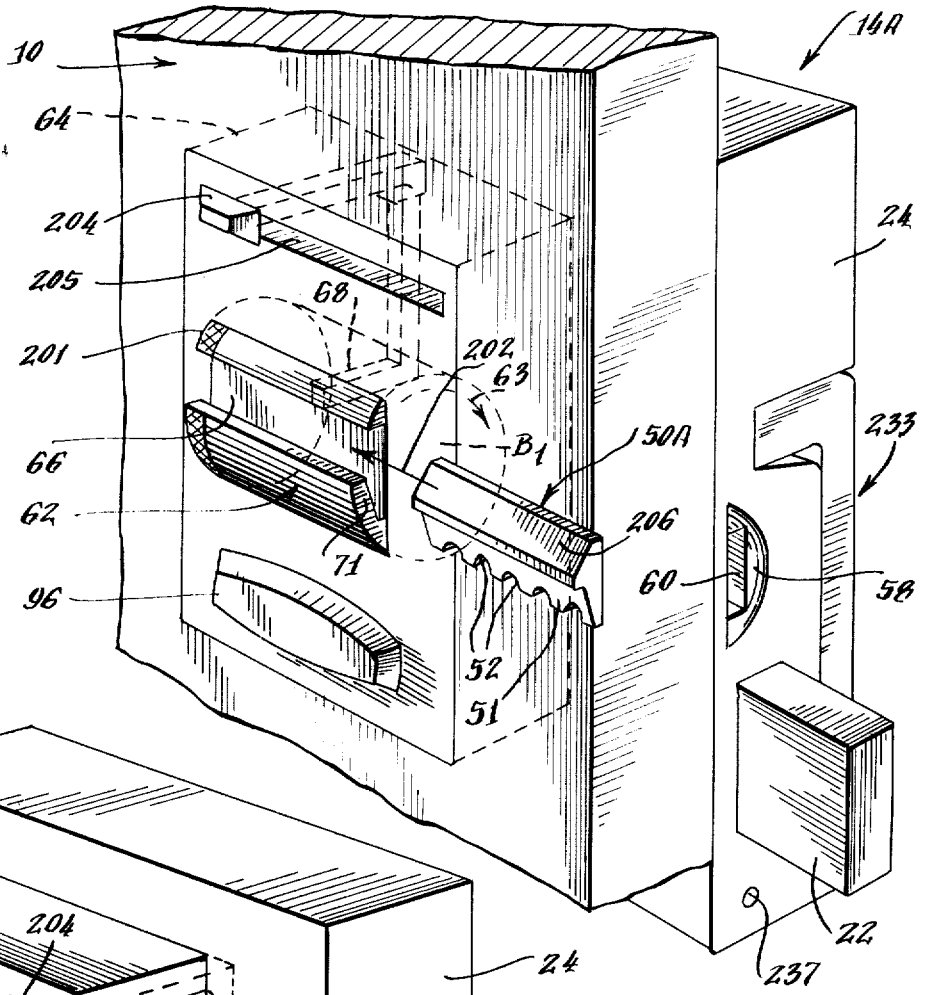
FIG. 10 is a perspective view of a second embodiment of the pick-proof lock system of the present invention, as seen from outside of the closure. This view also illustrates the transportable key formed to operate this embodiment of the lock system.
Figure 11:
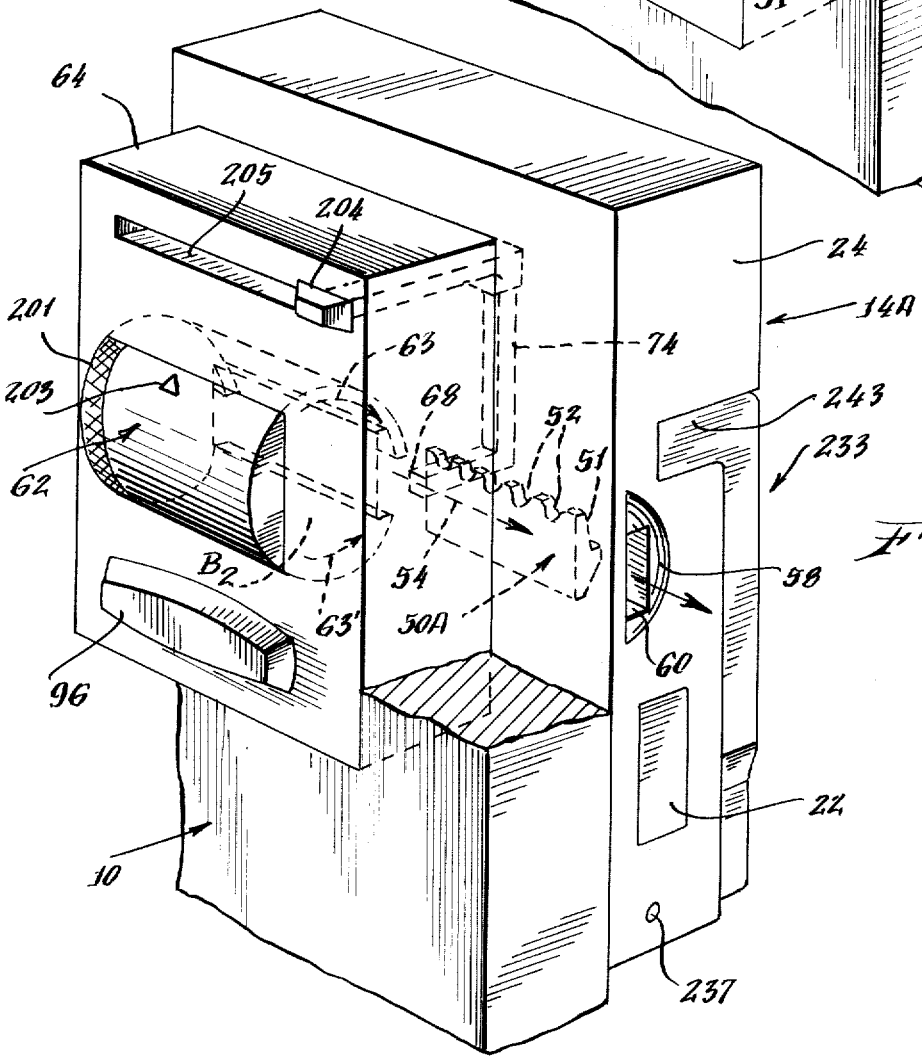
FIG. 11 is a perspective view of the lock system of FIG. 10, illustrating the key being moved into the coded lock means within the lock mechanism.
Figure 12:
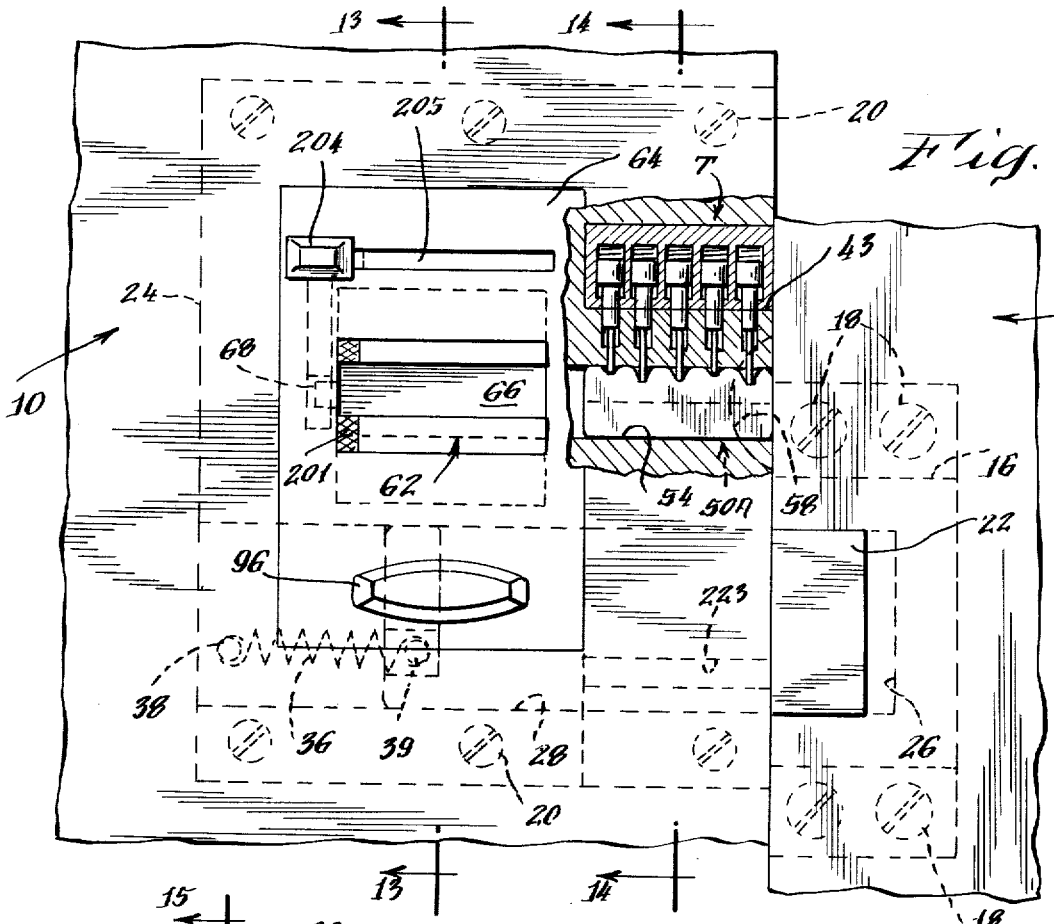
FIG. 12 is a front elevational view of this pick-proof lock system of FIGS. 10 and 11 as seen from outside of the door. A portion of a drum-type key carrier, manually movable key pusher or slider and a knob for positioning the latching member are illustrated in full lines. The coded lock means is partially broken away in section illustrating the key in operative relation for releasing the lock.

Referring to FIGS. 10 – 17, the pick-proof lock mechanism 14A is mounted on the inside of the movable closure barrier 10, such as a door, window, gate, cover, hatch, drawer, or the like, so that this lock mechanism is remote from the public region, which is located at the left in FIGS. 10 and 11. FIG. 12 shows the barrier 10 in closed relationship with a cooperating barrier 12, which may be fixed, for example such as a door frame or jamb, window frame, wall locker, cabinet, partition, or which may be a cooperating movable barrier 12 such as a second door, window or gate adapted to be locked together with first barrier 10 for forming a closure. The movable latching member or bolt 22 is engaged in the socket 26 of a cooperating latching member 16 secured to the barrier 12, thus barring entry until the movable latching member is withdrawn along its channel 28 to be disengaged from the other member 16. A spring 36 (FIGS. 12 and 15) hooked to a pin 38 in the lock housing 24 and hooked at 39 to the movable latching member 22 urges it towards its retracted position.

In operation the transportable key 50A (FIG. 10) is inserted into a receptacle 66 in a rotatable drum-shaped key carrier 62 which is knurled 201 (see also FIG. 12) at one end for ease of rotation. The key 50A is an elongated element with a pattern of coded depressions 52 along its lower edge as seen in FIG. 10, these depressions being of various depths. The key is inserted by sliding it endwise as indicated by arrow 202 into the open end of the receptacle 66. The drum carrier 62 has an axial length at least as great as the length of the key so that the end of the key does not project beyond the end of the receptacle 66 when it is inserted therein.

After the key 50A has been fully inserted into the receptacle 66 for starting its travel along the route to the remote coded lock means T (FIG. 12), the key carrier 62 is rotated about its axis for 180° by rolling with the thumb or finger on the knurled region 201. FIG. 11 shows the key carrier 66 after it has been rotated 180° for carrying the key 50A along a first path 63 through the closure barrier 10 into the interior of the main housing 24 of the lock mechanism 14A. The key carrier 62 may be rotated in either direction 63 or 63' when transporting the key. An index mark 203 may be inscribed in the cylindrical surface of the metal drum carrier 62 to let the user know that the key is now aligned with the intersection with the second path 54.

In order to move the key 50A along the second path 54 into the coded lock means T, the second key carrier 68 is moved toward the right in FIG. 11 by sliding a manually actuated knob 204 along a slot 205 as seen by comparing the positions of this knob as it appears in FIGS. 10 and 11. In this way the key is pushed by the carrier 68 into the coded lock means T, as shown in FIG. 12 for unlocking the closure barrier 10, 12.

Figure 13:
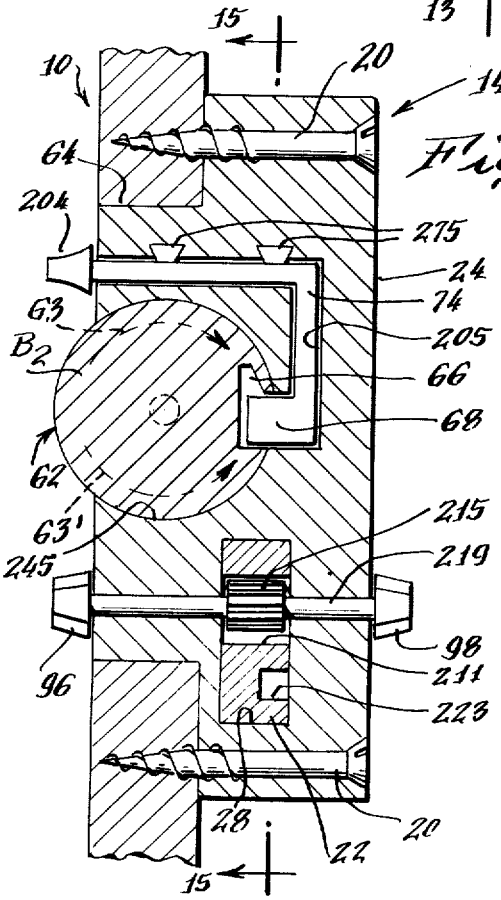
FIG. 13 is a cross-sectional view taken through the plane 13—13 in FIG. 12 looking toward the left. This view illustrates the drum-type key carrier, the manually movable J-shaped key pusher, and the knob and rotatable shaft for returning the latching member to its locked position.

As shown in FIG. 15, the bolt 22 has an elongated slot 211 which defines a gear rack 213 along its top. This gear rack is engaged by a pinion gear 215 mounted on an over-running clutch 217 which is carried on a transverse shaft 219 (FIG. 13). As shown in FIG. 13, this shaft is rotatable and projects out of both the front and back of the main housing 24, with knobs 96 and 98 provided at both ends of the shaft accessible respectively from the outside and inside of the door 10. The overrunning clutch 217, pinion 215, and the rack gear 213 are arranged so that proper rotation of either knob 96 or 98 causes the movable latching member 22 to move out of the housing 24 into engagement with the other latching member 16 for locking the closure. Rotation of either knob 96 or 98 in the opposite direction merely slips the overrunning clutch 217 and causes no movement of latching member 22.

As shown most clearly in FIGS. 15 through 17, the movable latching member 22 has an elongated groove 223 along its inner face which has an associated depressible detent member 225. This detent 225 is carried in a recess 227 and urged toward extended position by a compressible spring 229. This detent 225 is wedge-shaped in cross section as shown in FIG. 16, having an inclined outer face 231. Thus, as shown in FIG. 16, when securing means 239 is placed in the groove 223 the latching member 22 may be moved as shown by the arrow 216 toward its extended latching relationship with the other member 16 (FIG. 12). The detent 225 is depressed by its inclined surface 231 into its track 227 against the force of its spring 229 permitting the detent to pass securing means 239. However, when the detent 225 has entered the space 240 to the left of the securing means 239, the detent abuts against the securing means to prevent retraction of the latching member 22.

Figure 14:
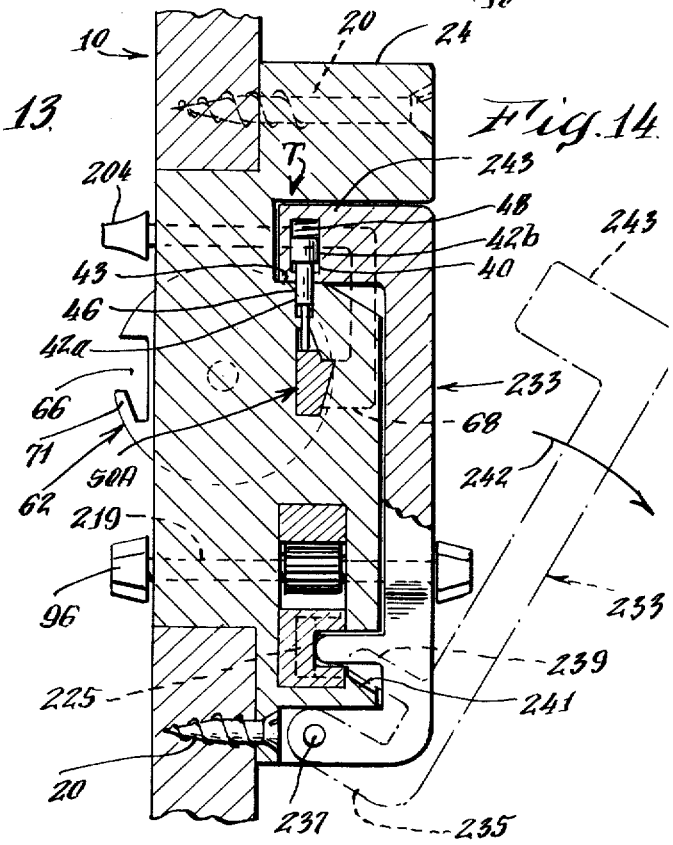
FIG. 14 is a cross-sectional view taken through plane 14—14 in FIG. 12 looking toward the left. This view illustrates in dash and dotted lines the releasing position of the latch securing member.

Referring to FIGS. 14 and 17 an arrangement for interposing such securing means 239 in the groove 223 is illustrated. A control member 233, which is generally E-shaped, has a lower leg 235 pivoted on a pin 237. The securing means 239 is a central leg positioned to project through an opening 241 in the main housing 24 into the groove 223. Thus, when the E-shaped control member 233 is swung into its securing position, as shown by solid lines in FIG. 14, the central leg 239 is positioned in the groove 223 as seen in FIGS. 14 and 16 so that the leg 239 is in readiness for engagement by the detent 225 (FIG. 16) for securing the movable latching member 22 locked in its extended position. However, for unlocking the closure barrier 10, the control member 233 is permitted to swing down 242 (FIG. 14) about the pin 237 as shown by dotted lines and then the movable latching member 22 is permitted to be retracted or withdrawn by its spring 36 into the housing 24 thereby unlocking the closure.

Later, when the control member 233 is returned to its locked position as shown by solid lines in FIG. 14, the knob 96 or 98 (FIG. 13) may be rotated to drive the movable latching member 22 outward causing the detent to slide (as shown in FIG. 16) past the securing means 239 to hold the movable latching member in its extended locked position for again locking the closure barrier 10.

The coded lock means for holding the E-shaped control member 233 in its locked position are illustrated in FIGS. 12 and 14. This coded lock means T is shown as a tumbler mechanism which includes a series of holes 46 disposed in the main housing 24 with a corresponding series of holes 40 in the upper leg 243 of the control member 233. These latter holes 40 have enlarged upper portions as seen in FIGS. 12 and 14 for retaining segments of the tumblers as will be explained. A two-segment tumbler 42 is carried in each hole 40, 46. The lower segment **42*a* of each tumbler has enlarged and reduced diameter portions which form a shoulder at their juncture. This shoulder is designed to abut the juncture of the enlarged and reduced diameter portions of the holes 46 to prevent the lower tumbler segment 42*a* from dropping out of their holes 46.**

Similarly, the upper segments **42*b* of the two-segment tumblers are retained in the corresponding series of holes 40 by having an enlarged and a reduced diameter portion which form a shoulder. The holes 40 are each formed with a shoulder to prevent the upper tumbler segments 42*a*** from falling out of their respective holes.

Each two-segment tumbler **42*a*, 42*b* is urged downwardly by a compressed spring 48 so that normally a part of the upper tumbler segment 42*b* will project downwardly into one hole 46 in the main housing when the control member 233 is in its securing position as shown in solid lines in FIG. 14. In this manner the E-shaped control member 233** is locked upright in its latch-securing position by the coded lock means T.

This lock means T is coded in a fashion similar to that described in relation to FIGS. 6 and 8 by choosing various lengths of the two tumbler segments **42*a*, 42*b*. When each tumbler is moved downward under the influence of its spring 48 its upper segment 42b extends into both holes 40 and 46 (FIG. 14) thus locking the control member 233 in its upright latch-securing position. However, as shown in FIG. 12, when all of these tumblers 42*a*, 42*b* are forced upwardly by preselected amounts against the springs 48 by an appropriately coded key 50A, the interfaces between the respective upper and lower tumbler segments 42*a* and 42*b* are caused to coincide with the interface 43 between the upper leg 243 of the control member 233 and the main housing 24. At this time, the control member 233 becomes unlocked and swings down as shown at 242 in FIG. 14, thereby withdrawing the securing means 239 from engagement with the detent 225 so that the movable latching member 22 can be retracted by its spring 36.**

A key guideway 54, shown in FIGS. 12, 14 and 15 is formed in the main housing 24 to guide the key 50A to the coded lock means T. This key guideway 54 is dimensioned to permit free movement of the key 50A along the second path which the guideway 54 defines. The key may be inserted directly into the guideway 54 through a discharge end 60 and thus into engagement with the coded lock means T. This method of inserting the key directly into the coded lock means T is for use by occupants inside of the closure barrier 10, 12. A finger clearance depression or cut-out 58 is provided so that the user may conveniently grip the key 50A while inserting or removing it from the discharge end 60 of the key guideway 54. There is clearance above the socket member 16 inside of the barrier 12 as seen in FIG. 12, to enable the user to put the key into the cut-out 58 when the barrier 10 is closed and locked. Again, as was the case with the first embodiment, the key 50A may be rejected from the discharge end 60 of the guideway 54, whether or not the coded lock means T is locked or unlocked.

In addition to inserting the key directly into the guideway 54 from inside the closure barrier as discussed in the paragraph above, the key may be inserted from outside the door by transporting it through the first path 63 or 63' (FIGS. 10 and 11) by means of the first key carrier 62 as explained further above. As shown in FIGS. 10, 11 and 13, the first key carrier 62 employed in this second embodiment of the present invention is a roller drum rotatably mounted in a cylindrical socket 245 (FIG. 13) in a front housing portion 64 of the main housing 24. A section of the drum carrier projects outwardly from the front face of the front housing 64 of the lock mechanism 14A. The cylindrical roller drum carrier 62 is provided with at least one key-accepting receptacle 66 extending axially of the drum and disposed to be exposed beyond the face plate when rotated toward the outside of the closure barrier as shown in FIG. 10.

As shown in FIG. 10, the key 50A has an indexing face 51 extending along its length, and the receptacle 66 has a projecting lip 71 formiing a cooperating index to insure that the key is put into the receptacle 66 with the coded notches 52 facing down. Then, after the carrier drum 62 has been turned 180°, the key is inverted with the notches on top as shown in FIGS. 11, 12 and 14. The key 50A also has a sloping rounded shoulder 206 (FIG. 10) which conforms with and forms a completion of the peripheral cylindrical surface of the roller drum carrier 62 when the key is inserted into the receptacle slot 66. Thus, as the drum carrier is rotated in its cylindrical socket 245 (FIG. 13), the sloping shoulder 206 of the key rides against the cylindrical surface of the socket 245 for retaining the key in place. The peripheral region of the key receptacle 66 is open to allow the key shoulder 206 to ride against the socket 245 and also to provide access to the second key carrier 68.

If desired, a second key receptacle may be provided angularly displaced 180° from the receptacle 66. This second receptacle would be located slightly below the index mark 203 (FIG. 11). However, a single receptacle 66 as shown in FIGS. 10, 11 and 13 works well. It is to be noted that the first path 63 or 63' through which the key travels as moved by the carrier 62 is offset or non-collinear with the second path 54 defined by the key guideway leading into the coded lock means 54. The total route followed by the key has an arc-shaped first path 63 or 63' and a linear second path extending in an axial direction, that is perpendicluar to, the plane of the first arc path. This route is best illustrated by FIGS. 10 and 11.

It will be appreciated that the coded lock means T at all times remains inaccessible to the public region outside of the closed barriers 10 and 12. The body of the roller drum carrier 62 serves both as first and second blocking means to accomplish this advantageous result. When the key receptacle 66 is exposed to the public region, as shown in FIG. 10, the body of the drum carrier 62 acts as first blocking means $B_1$ located behind the exposed receptacle 66. As the drum carrier is rotated to transport the key into the intersection with the second path 54, a transition occurs and the body of the drum carrier becomes positioned in front of the key receptacle now serving as second blocking means $B_2$ (FIG. 13). There is never a moment when the first path 63 or 63' is unblocked.

The second key carrier 68 acts as a ram or pusher and is mounted on an L-shaped traveller 74 (FIG. 13) carried in the correspondingly L-shaped slot 205 located in the main housing 24. Alignment of the traveler 74 in the slot 205 may be enhanced as shown in FIG. 13 by providing the traveller with elongated dove-tail slides 275 engaging in dove-tail tracks in the main housing 24. The L-shaped traveller 74 is provided with a knurled thumb tab 204 which may be operated by a person seeking to move the key 50A along the second path into the coded lock means T as shown by arrow 54 in FIG. 11. The key pusher or carrier 68 (FIG. 13) on the inner end of the L-shaped traveller 74 is aligned with the key receptacle 66 which is open at both ends and also open toward the periphery of the drum carrier 62. In FIG. 15 the reference number 68' shows the final position of the second key carrier after it has fully moved the key 50A into the coded lock means T so as to unlock it. Thus, the control member 233 (FIG. 14) swings down under its own weight to remove the securing means 239 from the groove 223 in the bolt 22, allowing the bolt to be retracted by its spring 36 for unlocking the closure barriers 10, 12.

As a first step in unlocking the closure 10, 12, the knob 204 (FIGS. 10 and 11) is returned to the left to its initial position as shown in FIG. 10, while the receptacle 66 is aligned with the carrier pusher 68, as shown in FIG. 13, to permit the pusher 68 to be returned. Then, the drum carrier 62 is rotated 180° to return the key receptacle 66 to its initial position as shown in FIG. 10. When there are two receptacles 66 on opposite sides of the roller drum carrier 62, then one of these receptacles is immediately available while the other is aligned with the carrier pusher 68 to enable it to be returned to its initial position.

Again, as was the case with the first embodiment of the present invention, if the key was not properly coded, it would not unlock the barrier. However, if a properly coded key was subsequently used as described above, it will eject the improperly coded key from the open end 60 (FIGS. 10 and 11) of the guideway 54.

Figure 18:
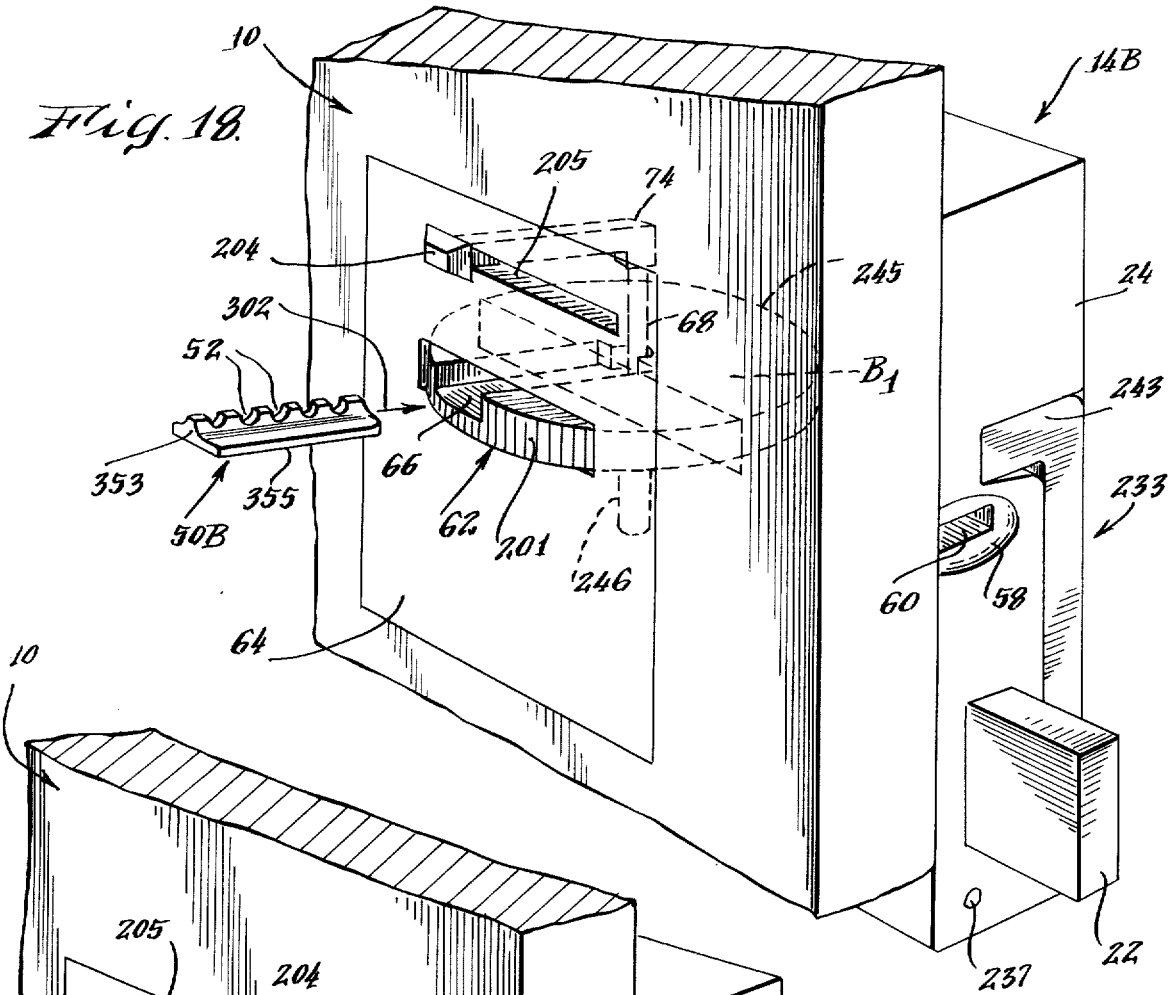
FIG. 18 is a perspective view of a third embodiment of the present invention. This third embodiment employs a turntable means for transporting the key into the lock mechanism, this lock mechanism being otherwise the same as that shown in FIGS. 10 through 17.
Figure 19:
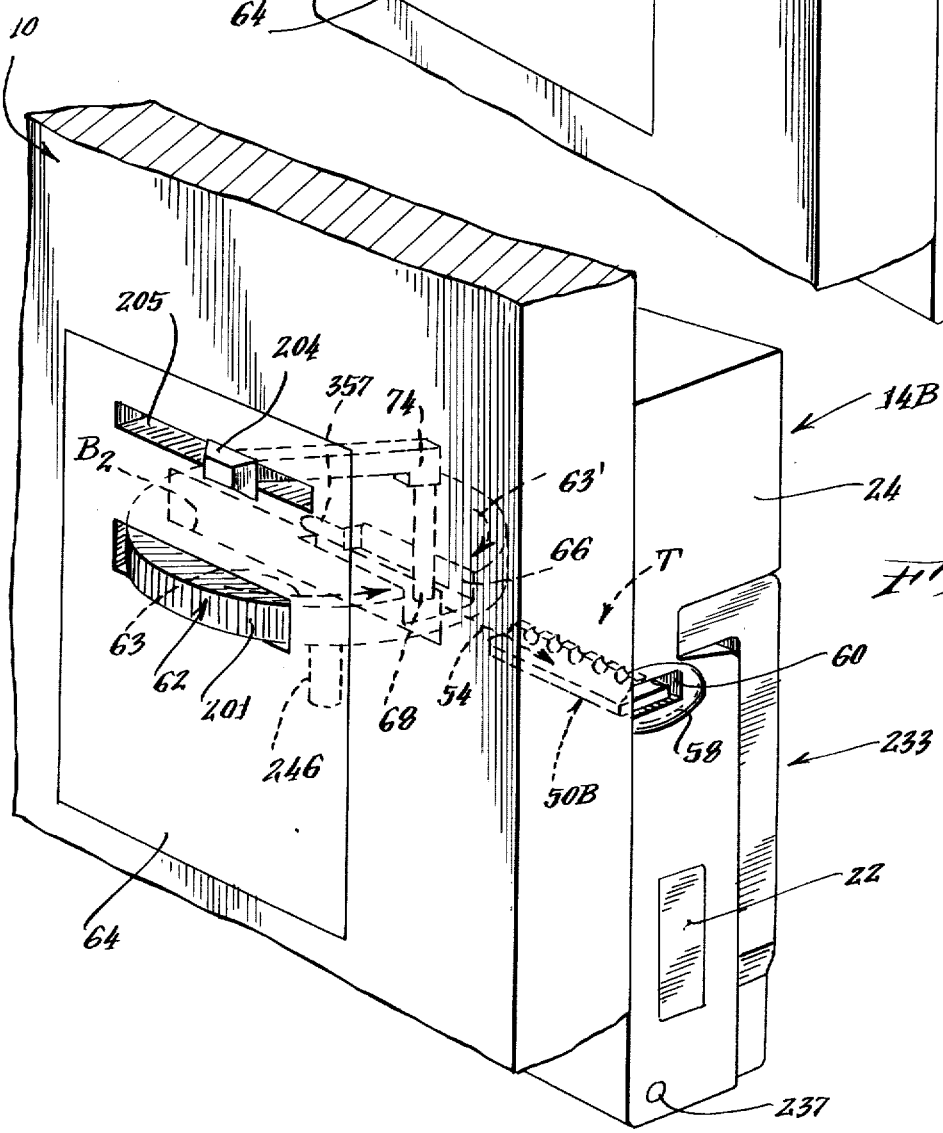
FIG. 19 is a perspective view of the lock system of FIG. 18 illustrating the key being moved into the coded lock means within the lock mechanism.

A third embodiment of the pick-proof lock system of the present invention is illustrated in FIGS. 18 and 19. A lock mechanism 14B identical in many respects to the mechanism 14A described with reference to the second embodiment may be employed with this third embodiment. Accordingly, a detailed description of this lock mechanism 14B including the key guideway 54, the coded lock means and moving latching member 22 with its securing E-shaped control member 233, will not be repeated.

This third embodiment of the present invention includes a first key carrier 62B in the form of a turntable disc rotatably mounted in the main housing 24 and front housing 64 of the lock mechanism 14B. This turntable carrier 62 is mounted on an axle shaft 246 and is positioned in a cylindrical socket 245 so that a portion of it projects out beyond the front face of the front housing 64 for access to the user on the outside of the closure barrier 10. The turntable carrier 62 has a radially disposed key receptacle slot 66 for accepting an elongated key 50B having a generally inverted T-shaped cross section. The coded notches 52 are positioned along the ridge 353 formed by the inverted stem of the T-shape. The cross bar of the inverted T-shape forms a base 355 on which the key can rest in a stable position with the ridge 353 upstanding for properly positioning the notches facing upwardly to engage the depending tumblers (not shown) of the coded locking means in the region T (FIG. 19).

The turntable carrier 62 may be rotated through 90° as shown in FIG. 19 so that the key receptacle slot 66 coincides and aligns with the key guideway 54.

A second key carrier in the form of a ram or pusher 68 is carried at the base of an L-shaped traveller 74 in an L-shaped slot 205. A thumb tab 204 is provided on the traveller 74 for use by the operator in moving it. As shown in FIG. 18, the key pusher 68 is a vertical leg of the L-shaped traveller 74 which is located on and aligned with the axis of the turntable carrier 62 when the pusher 68 is in its initial position. When so located, the turntable key carrier 62 may be rotated about it.

The pick-proof lock system of this third embodiment of the present invention is operated as follows: the turn-table carrier 62 is rotated so that the key receptacle slot 66 is exposed to the outside of the front housing 64 and hence to the outside of the closure barrier 10. The key 50B is then inserted as indicated by arrow 302 into the key receptacle radial slot 66. The rotatable key carrier 62 is rotated 90° by pushing on its knurled periphery 201 as shown by arrow 63 or it could be rotated 270° in the opposite direction as shown by the arrow 63' for carrying the key along a first arcuate path. This rotation 63 or 63' aligns the key receptacle slot 66 with the key guideway 54 in the lock mechanism 14B. The second key carrier in the form of the pusher 68 may then be moved to the right as shown by arrow 54 in FIG. 19 to move the key from the receptacle slot 66 along the key guideway and thus into operative relation with the coded lock means located at T, but not shown since it is identical to that shown in FIGS. 12, 14 and 15, except that the key guideway 54 has a lower wider rectangular shape as can be seen by comparing its open end 60 with that as seen in FIGS. 10 and 11.

The pusher 68 when in its initial position fits into a recess 357 at the inner end of the receptacle slot 66. The shoulders 359 on either side of this recess serve as stops when the key 50B is inserted.

The coded lock means T remains at all times inaccessible from and blocked from the public region outside of the closed barrier 10 in FIGS. 18 and 19. The body of the turn-table disc carrier 62 serves both as first and second blocking means to provide this desirable result. When the radial key receptacle 66 is exposed to the public region, as shown in FIG. 18, the body of the turntable carrier serves as first blocking means $B_1$ located behind and to the right of the exposed receptacle 66. As the turntable carrier is rotated to transport the key into coincidence and alignment with the intersecting path 54, a transition occurs and the body of the turntable carrier now becomes positioned in front of the key receptacle, thus serving as second blocking means $B_2$. The first arcuate path 63 or 63' is never unblocked.

A fourth embodiment is illustrated in FIGS. 20 and 21, in which the force of gravity is used to transport the key 50B through the first path 63 so as to deposit the key in a key guideway 54. Again, the lock mechanism 14C employed with this fourth embodiment is almost identical to that described with reference to the second embodiment 14A. The key 50B in FIG. 20 is identical to the key 50B shown in FIGS. 18 and 19.

This fourth embodiment of the present invention includes a gravity chute 462 which forms a first key carrier. This chute includes an inlet opening 466 in the front face of the front housing 64 of the lock mechanism 14C, exposed to the outside of the closure barrier 10. A downwardly inclined surface 467 mates at one end with the bottom edge of the inlet opening 466 and at the lower end with the nearer edge of the key guideway 54. The chute 462 is formed so that when a key 50B is deposited base 355 down in the inlet 466, the force of gravity causes it to slide down the inclined surface 467 to land horizontally base down and longitudinally aligned in the key guideway 54.

A second key carrier in the form of a ram or pusher 68 is positioned to operate on a key deposited on guideway 54 at the base of the chute 462. This pusher is mounted at the end of the inner leg of an L-shaped traveller 474 which has at its opposite end a thumb tab 204. Unlike the L-shaped travellers 74 shown in FIGS. 10, 11, 13, 18 and 19, which are moved in a direction perpendicular to the plane of the L-shape, this traveller 474 is moved in a direction parallel with its inner leg.

When a key is deposited in the chute and it arrives in operative relation to the key guideway 54, the second key carrier or ram 68 may be moved along a slot 405 by pushing the thumb tab 204 toward the right as shown in FIGS. 20 and 21. This motion pushes the key 50B into operative engagement with the coded lock means located in the region T, but not shown.

This fourth embodiment of FIGS. 20 and 21 is operated as follows: a key 50B is deposited in the inlet opening 466 of the chute 462. Acted upon by gravity, it slides down through the chute and lands in longitudinally aligned relation with the key guideway 54. Near the juncture of the rear surface of the chute 462 with the key guideway 54, this rear surface is cylindrically curved at 468 from steep downwardly inclined pitch into a more gradual pitch to guide the descending key into a horizontal position as it lands on the guideway 54. There is a stop surface 469 extending parallel to the guideway 54 which is located at the juncture of the curving rear wall 468 and the guideway 54 for aligning the key with its intended second path of travel as defined by this guideway 54.

The ram or second key carrier 68 may then be manually operated by pushing the thumb tab 204 to the right (FIG. 21) to push the key along the second path provided by the key guideway into operative relation with the coded lock means T. In other respects, the lock mechanism 14C in a manner similar to that described with respect to the second embodiment 14A.

FIGS. 22 through 28 illustrate a fifth embodiment of a pick-proof lock system of the present invention. This embodiment employs first key carrier means including two counterrotating cooperating roller drums to define the first path along which a key is transported into the lock mechanism.

The lock mechanism 14D of this fifth embodiment is generally similar to the lock mechanism 14A of FIGS. 10 through 17 in that roller drum carrier means are used to carry the transportable key along the first path segment of the route into the coded lock means T. However, a pair of drum carriers are used in this mechanism 14D. Also, as seen most clearly in FIG. 27 the control means 233 for securing the movable latching member 22 in its locked condition is generally J-shaped and slides vertically, as will be explained in more detail further below. The structure of this pick-proof lock mechanism 14D may be most easily understood by considering its operation.

The pick-proof lock system of this fifth embodiment of the present invention is operated as follows: the first roller drum carrier 62-1 of the dual roller drum type key carrier 62-1 and 62-2 is rotated to expose its key receptacle depression 66-1 outside of the face of the front housing 64 which is located on the outside of the closure barrier 10. A key 50D is then deposited in this depression 66-1, and this first drum carrier is rotated in a clockwise direction (FIG. 26) moving the key into the lock mechanism and depositing it into the second receptacle 66-2 in the second roller drum carrier 62-2 which is carried thereby and finally be deposited in the key guideway 54. The thumb tab 204 is then operated by moving it to the right along the slot 405 to move the traveler 474 to, in turn, operate the second key carrier 68 moving the key 50D into operative relation with the coded lock means T.

This coded lock means T in FIG. 25 is identical to that shown in FIGS. 12 and 14, except that the tumblers extend in a horizontal plane. The transportable key 50D is an elongated strip approximately 3/32 of an inch thick having coded notches 52 extending along one edge of the strip. If desired there may be an index mark 503 (FIG. 22) in the bottom of the first receptacle and a corresponding mark 503' on the surface of the key 50D which is intended to face outward radially with respect to the first roller drum carrier 62-1. Also, this index mark reminds the user to face the coded edge 52 upward in the receptacle.

The cylindrical sockets 245-1 and 245-2 (FIG. 26) closely encircle the respective roller drum carriers 62-1 and 62-2 for preventing the key 50D from falling out of their respective receptacles 66-1 and 66-2. These drum carriers have projecting axles 546-1 and 546-2 journaled in the housing 24 at opposite ends of the sockets 245-1 and 245-2.

In order to synchronize the rotation of these roller drum carriers to bring the two receptacles 66-1 and 66-2 together in aligned communication so that the key 50D can slide down and become transferred from the receptacle in the upper drum into the receptacle in the lower drum, there are interengaging gear wheels 547-1 and 547-2 attached to one end of each drum carrier. These gear wheels are of equal diameter so that when the outer-upper drum carrier 62-1 is turned one full revolution the inner-lower drum carrier 62-2 is also turned one full revolution.

In order to provide clearance for the key pusher 68 in its initial position adjacent to the gear (FIG. 547-2, the key receptacle 66-2 (FIGS. 28) in the second roller drum is shorter than the axial length of the drum. Thus, there is a cylindrical region 568-2 adjacent to the gear wheel 547-2. In its initial position the key pusher 68 is directly beneath this cylindrical region 568-2 as seen in FIG. 28. Consequently, the key 50D is caused to drop from the receptacle 66-2 into the key guideway 54 into a position to the left as seen in FIG. 28 of the pusher 68 in readiness to be pushed as shown by the arrow into the coded lock means T (FIG. 25). There is a corresponding cylindrical region 568-1 in the outer drum carrier 62-1, thereby properly positioning the key for transfer from receptacle 66-1 into receptacle 66-2.

If the key 50D is properly coded to operate the coded lock means T (FIG. 25), the two-segmented tumblers **42*a* and 42*b* are moved against springs 48 so that their interfaces coincide with the interface 43 between the J-shaped shaped control mans 233 (FIG. 27) and the housing 24, thus unlocking the control member 233 permitting it to drop under the influence of gravity. This drops the securing means 239 out of engagement with the detent 225 to permit the spring 36 to retract the movable latching member 22. When retracted, the movable latching member 22 is withdrawn from a socket, for example such as shown in FIG. 12 at 26 in a cooperating latching member 16 to thereby unlock the door or other closure barrier 10**.

Again, if the key is improperly coded, it will not unlock the closure. When a properly coded key is used in the fashion described above, it ejects the improper key from the discharge end 60 of the key guideway 54.

The lock may be opened from inside of the closure barrier 10 by inserting a properly coded key into the discharge end 60 of the key guideway.

The securing means 239 (FIGS. 27 and 28) is an upraised toe element on the foot 551 (FIG. 28) of the J-shaped control member which fits up into a groove 223 in the lower edge of the movable latching member 22 when the control means 233 is in its raised position. This control means 233 slides in a channel 553 (FIGS. 25 and 27) in the main housing 24.

The outer-upper drum carrier 62-1 has its axis located on a line which inclines downwardly at an angle of approximately 45° to the axis of the inner-lower drum carrier 62-1. In its initial position as shown in FIG. 22, the body of the first drum carrier serves as first blocking means $B_1$ positioned behind the key receptacle 66-1. Later, when the receptacle has been revolved into a position within the front housing 64, the body of this drum carrier serves as second blocking means located in front of the key receptacle 66-1. In addition, the second drum carrier 62-2 serves as additional blocking means for blocking the first path into lock mechanism 14D. There is no time when the coded lock means T is accessible through this first path into the lock mechanism.

Types of coded lock means T other than the tumbler assemblies described may also be used. For example, a magnetically coded key and similar sensing system may be utilized with an appropriate means for locking the bolt 22. As used in this application, the term coded lock means is intended to include coded releasable lock means which respond to an appropriate coded key but will not respond to other differently coded keys, for example such as a plurality of coded probes for sensing the coded key.

The pick-proof lock system may be arranged to transport a key of other configuration, such as a coded cylinder or a coded bar along a route to coded lock means such as a tumbler assembly with obstacles provided to prevent access from the outside region into the tumbler assembly. Instead of moving the two key carrier means 62 and 68 manually, after the key has been inserted, motive means such as an electric motor or solenoid electromagnet may be provided for moving each carrier automatically. Moreover, as an alternative to using a spring 36 to withdraw the movable latching member 22, after the key has been inserted, motive means, such as an electric motor or solenoid electromagnet, may be provided to withdraw it. Alternatively, the handle 96 may be arranged to effectuate the withdrawal of the latching member 22 when this handle is turned back to its original position, such as shown at 99 in FIG. 1.

The pick-proof lock system of the present invention has several unique and novel advantages. Since the system operates by transferring the key into the interior of the lock mechanism, the coded lock means such as a tumbler assembly is removed from access by a picking tool. The key, in entering the mechanism and being transported to the tumbler assembly, must traverse a route which is blocked by obstacles. The key carrier itself is an obstacle to access when the carrier is moved to transport the key toward the tumbler assembly. The route traversed by the key is broken up into two different paths intersecting each other, and the carrier means for moving the key comprises two different carriers which act in sequence to move the key along the first and the second paths respectively. Thus, any picking tool must be capable of being operated around the corner formed at the intersection of the first path and the second path. Even if a tool were capable of such operation, its access to the tumbler assembly is blocked by blocking means formed by the first key carrier means 66 or 66-1 and 66-2 which cannot be completely removed.

Further, a burglar with a counterfeited key could not retrieve that key once he had attempted to use it. The owner is prevented from leaving his key in the lock to copy it, since the key must be moved into the interior of the lock to actuate the coded lock means such as a tumbler assembly.

As shown in FIGS. 29A and 29B the first path along the chute 462 in FIGS. 20 and 21 may be blocked by blocking means $B_1$ and $B_2$ comprising a pivoted lever 470 having a horizontal pivot pin 471. This pivoted lever is gravity biased to assume its initial position as shown in FIG. 29A in which the lower leg of the lever 470 serves as first blocking means $B_1$. When the key 50B is moved down the first path through the chute 462, as seen in FIG. 29B, it pushes the first blocking means $B_1$ aside while the upper leg of this lever 470 acting as second blocking means $B_2$ swings over behind the key for blocking access.

The second blocking means $B_2$ is held in its blocking position by the second key carrier 68 (FIGS. 20 and 21) when this carrier is advanced as shown by the arrow 54 in FIG. 21, for this carrier then occupies the position 68' shown dotted in FIG. 29B, where it engages the lower leg of the lever 470. As seen in FIGS. 29A and B, the inner surface of this lever 470 acting in sequence as the key advances down the chute serve to define the inclined surface 467 of the chute 462. When the carrier 68 has been returned to its initial position by returning the thumb tab 204 to its initial position as seen in FIG. 20, then the lower leg of the lever 470 is released, and the blocking means $B_1$ is swung back into its initial position as shown in FIG. 29A. It is to be noted that FIGS. 29A and B are enlarged partial sectional views as seen looking along the plane 29—29 in FIG. 20. The blocking means 470, $B_1$ and $B_2$ is omitted from FIGS. 20 and 21 for clarity of illustration.

I claim:

1. A pick-proof method of locking and unlocking a closure including a movable barrier mounted to close and protect an inside region from an outside region, said method comprising the steps of:

providing a locking mechanism for locking said barrier closed, providing key responsive coded lock means for controlling said locking mechanism, positioning said coded lock means remote from said outside region in a position which is inaccessible from said outside region when said barrier is closed, providing a route for a transportable key beginning at said outside region and extending into said coded lock means, blocking said route to prevent access to said coded lock means from said outside region, providing a transportable key adapted to travel said route and placing said key into the beginning of said route at said outside region, progressively unblocking portions of said route, moving said key along each progressively unblocked portion of said route into operative relationship with said coded lock means for unlocking said lock mechanism, sequentially reblocking each portion of said route after said key has been moved through that portion, thereby to deny access to said coded lock means from said outside region to prevent said coded lock means from being picked, while enabling said lock mechanism to be unlocked by moving a key along said route into engagement with said coded lock means.

2. A pick-proof method of locking and unlocking a closure including a movable barrier mounted to close and protect an inside region from an outside region, said method comprising the steps of:

providing a locking mechanism for locking said barrier closed, providing a key responsive assembly for controlling said locking mechanism, positioning said key responsive assembly remote from said outside region in a position which is inaccessible from said outside region when said barrier is closed, providing a route beginning at said outside region and extending into said key responsive assembly, said route including first path extending from the outside region, and a second path intersecting said first path at an angle thereto and extending into said key responsive assembly, blocking said route to prevent access to said key responsive assembly from said outside region, placing a key into the beginning of said route at said outside region, moving said key along said route into operative relationship with said key responsive assembly for unlocking said lock mechanism while continuing to block said route, thereby to deny access to said key responsive assembly from said outside region to prevent said assembly from being picked, while enabling said lock mechanism to be unlocked by moving a key along said first and second paths of said route.

3. A pick-proof method of locking and unlocking a door, window, or other closure including a first movable barrier mounted to close with a second barrier to separate and protect a region inside of said closure from an outside region; said method comprising the steps of:

providing a fixed latching means, adapted to be mounted in fixed relationship on one of the closure barriers, providing a lock mechanism adapted to be mounted on the other of said closure barriers and having a movable latching means, locking said movable latching means in locking engagement with said fixed latching means by means of a coded lock means associated with said lock mechanism, positioning said coded lock means in a location where it is inaccessible from the outside region, providing a transportable coded key adapted to unlock said coded lock means by being engaged therewith, providing a route for said transportable key extending from said outside region to said coded lock means, blocking said route before the key has moved along said route, placing the transportable key in said route at said outside region, moving the transportable key away from the user's hand along said route into operative engagement with said coded lock means for unlocking said movable latching means while unblocking the portion of the route where the key is moving while again blocking the route behind the key, whereby access to the coded lock means from said outside region through said route remains at all times blocked from said outside region, even when the key is being moved along said route.

4. A pick-proof method of locking and unlocking a door, window, or other closure including a first movable barrier mounted to close with a second barrier to separate and protect a region inside of said closure from an outside region; said method comprising the steps of:

providing a fixed latching means, adapted to be mounted on one of the closure barriers, providing a lock mechanism adapted to be mounted on the other of said closure barriers having a movable latching means, locking said movable latching means in locking engagement with said fixed latching means by means of a coded tumbler assembly associated with said lock mechanism, positioning said tumbler assembly in a location where it is inaccessible from the outside region, moving a coded key away from the user's hand along a route extending from the outside region through the closure barrier into the lock mechanism into operative engagement with said tumbler assembly for unlocking said tumbler assembly to unlock said movable latching means, said route along which said key is moved including a first path extending from said outside region into said lock mechanism, and a second path in said lock mechanism extending into said tumbler assembly, said second path intersecting said first path and extending at an angle to said first path, blocking portions of said route before, during, and after the key has moved away from the user's hand to prevent anyone in said outside region from gaining access to said tumbler assembly.

5. The pick-proof method of locking and unlocking a door, window, or other closure including a first barrier mounted to close with a second barrier to separate and protect a region inside of said closure from an outside region as claimed in claim 4, in which:

said first and second intersecting paths define a route along which the key is moved having an L-shaped configuration.

6. A pick-proof lock system for a door, window, or other closure including a movable barrier mounted to close and protect a region inside of said closure from an outside region, said lock system comprising:

a movable latching member;

a lock mechanism associated with said movable latching member;

said lock mechanism having key responsive coded lock means for locking said movable latching member for securing said barrier in closed position;

said lock mechanism being adapted to be mounted with said coded lock means remote from said outside region when said barrier is closed;

said lock mechanism having a housing portion adapted to extend to the outside region for defining a route along which a transportable key can be moved from said outside region to said coded lock means;

movable key carrier means positioned on said route;

said key carrier means being movable into a key receiving position for receiving a transportable key from a user in said outside region, said carrier means being movable along said route into a second position for moving the key away from the user in said outside region toward operative engagement with the said coded lock means for unlocking the lock mechanism; and blocking means operatively associated with said carrier means for blocking said route for preventing access to said coded lock through said route from said outside region;

said blocking means being positioned in said route between said key carrier means and said coded lock means when said key carrier means is in said key receiving position and being positioned in said route between said key carrier means and said outside region when said key carrier means is moved into said second position, whereby said coded lock means can be unlocked by the transportable key but said coded lock means remains inaccessible from said outside region through said route because said route remains blocked at all times to prevent picking of the lock mechanism.

7. A pick-proof lock system for a door, window, or other closure including a movable barrier mounted to close and protect a region inside of said closure from an outside region, said lock system comprising:

a movable latching member;

a lock mechanism associated with said movable latching member;

said lock mechanism having a coded key responsive assembly for locking said movable latching member for securing said barrier in closed position;

said lock mechanism being adapted to be mounted with said key responsive assembly inaccessible from said outside region when said barrier is closed;

said lock mechanism having a housing portion adapted to extend to the outside region for defining a route from said outside region to said key responsive assembly;

movable carrier means positioned on said route;

said carrier means being movable into a position for receiving a key from a user in said outside region, said carrier means being movable along said route for moving the key away from the user in said outside region into operative engagement with the said key responsive assembly for unlocking the lock mechanism;

means blocking said route for preventing access to said key responsive assembly from said outside region, said route from said outside region to said key responsive assembly including a first path accessible from said outside region and a second path intersecting said first path, said second path being at an angle to said first path and being inaccessible from the outside region;

said movable carrier means including a first carrier member movable into a position for receiving a key from said outside region and being movable for carrying said key into said lock mechanism along said first path and including a second member for moving said key along said second path into operative engagement with said key responsive assembly, where said key operates said key responsive assembly, where said key operates said key responsive assembly to release said lock mechanism; and said blocking means being a portion of said first carrier member, whereby said lock mechanism can be unlocked by the key but said key responsive assembly remains inaccessible from said outside region to prevent picking of the lock mechanism.

8. Pick-proof lock apparatus comprising:

a housing containing coded lock means located remote from the exterior of said housing, said housing defining a route extending from the exterior of said housing to said coded lock means, said route being adapted to have a key moved therealong, said route including two paths, a first of said paths being accessible from the exterior of said housing and extending into said housing and said route including a second path intersecting said first path at an angle thereto and extending from said first path toward said coded lock means, said first path being adapted to have a key moved therealong from the exterior of said housing into said housing to the intersection with said second path, and keycarrier means in said housing movable along said second path, said key carrier means being positionable into an initial position for engagement with a key located at said intersection and means for moving said key carrier means along said second path for moving the key from said intersection along said second path toward said coded lock means for unlocking the lock mechanism.

9. A pick-proof lock system for locking a door, window or other closure including a first barrier adapted to close with a second barrier for separating and protecting an outside region from a region inside of the closure, said pick-proof lock system comprising:

a movable latching member which is movable into a first position for locking said barrier members together and being movable into a second position for releasing said barrier members;

a coded tumbler assembly for locking said latching member in said first position;

a housing for said tumbler assembly defining a second path leading to said tumbler assembly;

a first key carrier movable along a first path in a direction to be accessible from said outside region for receiving a key from said outside region;

said first key carrier being movable along said first path in a direction away from said outside region for transporting the key along said first path into said second path intersecting said first path;

said second path being offset from said first path; and a second key carrier movable along said second path for transporting said key to said tumbler assembly for unlocking said latching member, whereby said tumbler assembly is inaccessible from said outside region.

10. A pick-proof lock system for locking a door, window or other closure as claimed in claim 9, in which:

said first key carrier blocks said first path to prevent insertion of a lock-picking tool into said path.

11. A pick-proof lock system for locking a door, window, or other closure including a first barrier mounted to close with a second barrier for protecting a region inside of said closure from the region outside of said closure, said lock system comprising:

fixed latching means adapted to be mounted on one of said closure barriers;

a coded key;

a lock mechanism adapted to be mounted on the other of said closure barriers including a movably mounted latching member;

a tumbler assembly in said lock mechanism correspondingly coded to said key for locking said movably mounted latching member in engagement with said fixed latching member;

said lock mechanism defining a key guideway;

inner carrier means in said lock mechanism for moving said key through said guideway into operative engagement with said tumbler assembly;

outer key carrier means, offset from said tumbler assembly, said outer key carrier means being movable into a position accessible from said outside region for receiving the coded key and being movable along a carrier path into said lock mechanism for carrying said key along said carrier path into said guideway in operative relation with said inner carrier means, said carrier path and said guideway being noncollinear; and means for operating said inner carrier means to move said key into operative engagement with said tumbler member, whereby the tumbler assembly is inaccessible from said outside region.

12. The pick-proof lock system for locking a door, window, or other closure including a first barrier mounted to close with a secon outer key barrier claimed in claim 11 in which said outer key carrier means blocks said carrier path after said key has been carried into said guideway.

13. The pick-proof lock system for locking a door, window, or other closure including a first barrier mounted to close with a second barrier as claimed in claim 11 further comprising:

means for urging said movable latching member into an unlocking position, disengaged from said fixed latching means when said tumbler assembly is unlocked by said key.

14. The pick-proof lock system for locking a door, window, or other closure including a first barrier mounted to close with a second barrier as claimed in claim 11 where in said tumbler assembly includes:

at least one tumbler having two separate sections, said sections being resiliently carried in a bore in said movable latching member, and in a corresponding bore in said lock mechanism, one of said resiliently carried tumbler sections spanning said bores in said lock mechanism and said movable latching member when said bores are aligned to lock said bolt, said tumblers being coded, and wherein said key is a plate having at least one indentation in at least one of its faces, correspondingly coded to said tumbler, for depressing said tumbler to unlock said movable latching member.

15. The pick-proof lock system for locking a door, window, or other closure including a first barrier mounted to close with a second barrier as claimed in claim 14 wherein said carrier means comprises a slide, having a depression for accepting said key, mounted in said lock mechanism, said slide being adapted for partial withdrawal from said mechanism to expose said depression for accepting said key and further being adapted for retraction into said mechanism to deposit said key in said key guideway.

16. The pick-proof lock system for locking a door, window, or other closure including a first barrier mounted to close with a second barrier as claimed in claim 15 wherein said driving means comprises:

a shaft rotatably mounted in said slide for reciprocal movement therewith;

a similarly rotatable member mounted in said lock mechanism in axial alignment with said shaft;

coupling means for interengaging said shaft and said rotatable member when said slide is retracted into said lock mechanism; and a linkage between said rotatable member and said inner key carrier means.

17. Pick-proof lock apparatus as claimed in claim 8 in which said second path extends at right angles to said first path, said key carrier means includes a pusher engageable with the key for pushing the key along said second path, and said means for moving said key carrier is a manually actuatable member accessible on the exterior of said housing.

18. Pick-proof lock apparatus as claimed in claim 8 in which other key carrier means are also provided in said housing movable along said first path for moving the key along said first path to said intersection with the second path.

19. Pick-proof lock apparatus as claimed in claim 18 wherein said key carrier means comprises a slide movably mounted in said lock mechanism and having a receptacle for accepting said key, said slide being adapted for partial withdrawal from said mechanism to expose said receptacle for accepting said key and further being adapted for retraction into said mechanism to position said key in said key guideway.

20. The pick-proof lock system for locking a door, window, or other closure including a first barrier mounted to close with a second barrier as claimed in claim 11 wherein said outer key carrier means comprises at least one roller drum, having a receptacle therein for accepting the key, said roller drum being rotatably mounted in said lock mechanism, said roller drum being adapted to rotate to expose said receptacle for accepting the key and further being adapted to rotate into said lock mechanism to deposit the key in said key guideway.

21. The pick-proof lock system for locking a door, window, or other closure including a first barrier mounted to close with a second barrier as claimed in claim 11 wherein said outer key carrier means comprises first and second roller drums, each having a depression positioned in the respective peripheries thereof for accepting said key, said roller drums being rotatably mounted in said lock mechanism and coupled to rotate in opposite directions to register said depressions for transferring said key from said first roller drum to said second roller drum, said first roller drum being adapted for rotation to expose its depression for accepting said key and for rotation to transfer said key to the depression of said second roller drum, and said second roller drum being adapted for rotation to deposit the key in said key guideway.

22. The pick-proof lock system for locking a door, window, or other closure including a first barrier mounted to close with a second barrier as claimed in claim 11 wherein said outer key carrier means comprises a turntable disc, having a radially disposed slot for accepting the key, said turntable disc being rotatably mounted in said lock mechanism, said turntable disc being adapted for rotation to expose said slot for accepting the key and further being adapted for rotation into said lock mechanism for introducing the key into said key guideway.

23. The pick-proof lock system for locking a door, window, or other closure including a first barrier mounted to close with a second barrier as claimed in claim 11 wherein said outer key carrier means comprises a chute having an inclined surface extending from outside said barrier into said lock mechanism, said chute being adapted to transport said key along said inclined surface to deposit said key in said key guideway.

* * * * *